US011629040B1

(12) United States Patent
Gardner et al.

(10) Patent No.: US 11,629,040 B1
(45) Date of Patent: Apr. 18, 2023

(54) BEVERAGE DISPENSING SYSTEM MIXING NOZZLE

(71) Applicant: Mercury Plastics LLC, Middlefield, OH (US)

(72) Inventors: Scott Raymond Gardner, Chagrin Falls, OH (US); Donald Currey, Chagrin Falls, OH (US); Earl Christian, Chagrin Falls, OH (US)

(73) Assignee: Mercury Plastics LLC, Middlefield, OH (US)

( * ) Notice: Subject to any disclaimer, the term of this patent is extended or adjusted under 35 U.S.C. 154(b) by 142 days.

(21) Appl. No.: 16/877,131

(22) Filed: May 18, 2020

Related U.S. Application Data

(60) Provisional application No. 62/849,330, filed on May 17, 2019.

(51) Int. Cl.
*B67D 1/00* (2006.01)
*B01F 5/04* (2006.01)
*B01F 25/31* (2022.01)

(52) U.S. Cl.
CPC ..... *B67D 1/005* (2013.01); *B01F 25/311* (2022.01); *B67D 1/0021* (2013.01); *B67D 2210/0006* (2013.01); *B67D 2210/00049* (2013.01)

(58) Field of Classification Search
CPC ..... B67D 1/005; B67D 1/0021; B67D 2210/00049; B67D 2210/0006; B01F 5/0405
See application file for complete search history.

(56) References Cited

U.S. PATENT DOCUMENTS

| | | | | | |
|---|---|---|---|---|---|
| 2,837,749 | A * | 6/1958 | Gross | F16L 37/56 | 4/515 |
| 3,590,855 | A * | 7/1971 | Woollen | B67D 1/00 | 137/375 |
| 3,747,632 | A * | 7/1973 | Kok | F16L 59/153 | 137/375 |
| 4,247,135 | A * | 1/1981 | Weirich | E21F 17/08 | 285/124.4 |
| 5,803,320 | A * | 9/1998 | Cutting | B67D 1/0036 | 222/129.1 |
| 10,414,644 | B1 * | 9/2019 | Laible | B67D 7/0294 | |
| 10,576,702 | B1 * | 3/2020 | Laible | B67D 7/0294 | |
| 10,767,798 | B2 * | 9/2020 | Stein | E03C 1/0404 | |
| 2004/0217130 | A1 * | 11/2004 | Kado | B67D 1/0086 | 222/129.1 |
| 2006/0138170 | A1 * | 6/2006 | Brim | B67D 1/0052 | 222/129.1 |
| 2009/0236361 | A1 * | 9/2009 | Doelman | B67D 1/1252 | 222/1 |
| 2013/0340162 | A1 * | 12/2013 | Peel | G05D 7/0617 | 4/676 |

(Continued)

*Primary Examiner* — Donnell A Long
(74) *Attorney, Agent, or Firm* — Bose McKinney & Evans LLP

(57) ABSTRACT

The disclosure described herein relates to a beverage dispensing system mixing nozzle and a process for making or repairing the same. Particular examples of the present disclosure include a manifold comprising multiple tubes where the manifold is inserted into and secured within a seat of the mixing nozzle. In some examples, multiple manifolds are inserted into and secured within a seat of the mixing nozzle. The tubes extend into the body of the manifold to form a leak proof connection.

19 Claims, 34 Drawing Sheets

(56) References Cited

U.S. PATENT DOCUMENTS

| | | | | |
|---|---|---|---|---|
| 2014/0109526 | A1* | 4/2014 | Taylor | B67D 3/0064 53/467 |
| 2016/0009539 | A1* | 1/2016 | Jersey | B67D 1/0044 222/460 |
| 2018/0117606 | A1* | 5/2018 | Bertness | B05B 7/0408 |
| 2018/0362320 | A1* | 12/2018 | Wong | B67D 1/0406 |
| 2019/0330044 | A1* | 10/2019 | Conover | B67D 1/0046 |
| 2020/0354208 | A1* | 11/2020 | Roberts | B01F 3/0861 |

* cited by examiner

BEVERAGE DISPENSING SYSTEM MIXING NOZZLE

CROSS-REFERENCE TO RELATED APPLICATIONS

This application claims the benefit of United States Provisional Patent Application No. 62/849,330, filed May 17, 2019 with the United States Patent and Trademark Office, which is hereby incorporated by reference.

FIELD OF THE INVENTION

This disclosure relates generally to post-mix beverage dispensing systems. More specifically, this disclosure relates to a mixing nozzle for a beverage dispensing system and a method for assembling the same.

BACKGROUND AND SUMMARY OF THE INVENTION

Beverage dispensing systems are relied on for dispensing a wide variety of beverages at various points of sale where large quantities of beverages are dispensed such as, by example, sports stadiums, bars, restaurants, or the like. More specifically, a post-mix beverage dispensing system is a system relied on to evenly and efficiently distribute and mix the various components of a beverage such as, by example, the syrup, concentrate, water, carbonated water, or the like. Present post-mix beverage dispensing systems rely on a mixing nozzle with multiple dispensing tubes clamped thereto. These mixing nozzles, however, are cumbersome, difficult to assemble, and the clamps are susceptible to failure and leakage. Also, when a dispensing tube fails at the mixing nozzle the entire mixing nozzle must be repaired or replaced. This can lead to lengthy downtimes and the loss of production and profits as the entire beverage dispensing would not be operable during this time. In one specific prior art example, there are fifty six (56) clamps used to secure 28 separate tubes to a mixing nozzle, with two clamps required for each tube, which ultimately creates fifty six (56) separate leak points. In view of these deficiencies, there is a need for an improved beverage dispensing system mixing nozzle and method for assembly of the same that is leak-proof and does not require any clamps.

The disclosure described herein relates to an apparatus and process to provide a post-mix beverage dispensing system having a mixing nozzle that is leak-proof.

In one example, a manifold for a beverage dispensing system is disclosed. The manifold comprises a body where the body includes a plurality of pathways. The plurality of pathways extend from a top side of the body to a bottom side of the body. A plurality of tubes are also disclosed. Each tube of the plurality of tubes extend into a respective pathway of the body. Each tube forms a leak proof connection between a respective pathway of the plurality of pathways.

Also disclosed is a beverage dispensing system mixing nozzle. In one example, the beverage dispensing system mixing nozzle comprises a plurality of manifolds. Each manifold comprises a body where the body includes a plurality of pathways. The plurality of pathways extend from a top side of the body to a bottom side of the body. A plurality of tubes are also disclosed. Each tube of the plurality of tubes extend into a respective pathway of the body of a manifold. Each tube forms a leak proof connection between a respective pathway of the plurality of pathways.

The beverage dispensing system mixing nozzle is free of any clamp or clamps for securing the tubes.

The beverage dispensing system mixing nozzle also comprises a seat. The seat is for receiving the body of each manifold of the plurality of manifolds. The seat comprises an open top for receiving each manifold of the plurality of manifolds and an open bottom where the plurality of pathways are open through the open bottom. The beverage dispensing system mixing nozzle may also comprise at least one securing mechanism. The securing mechanism is for securing each manifold of the plurality of manifolds to the seat.

The foregoing and other objects, features and advantages of the disclosure will be apparent from the following more detailed descriptions of particular examples of the disclosure, as illustrated in the accompanying drawings wherein like reference numbers represent like parts of the disclosure.

BRIEF DESCRIPTION OF THE DRAWINGS

Reference is made to the accompanying drawings in which particular examples and further benefits of the disclosure are illustrated as described in more detail in the description below, in which.

DETAILED DESCRIPTION OF PARTICULAR EMBODIMENTS

Examples of the present disclosure include a leak-proof mixing nozzle for a beverage dispensing system and a process for assembling the same. Specifically, the present disclosure includes various combinations of tubes, manifolds and a nozzle provided in a variety of orientations.

FIGS. 1-6 illustrate an example of a mixing nozzle 100 comprising multiple manifolds 200. Each manifold 200 further comprises one or more tubes 300 extending therefrom. FIGS. 7-12 illustrate another variation of the above example of a mixing nozzle 100 also comprising multiple manifolds 200 and further illustrating one example of a securing mechanism.

Figure 23:
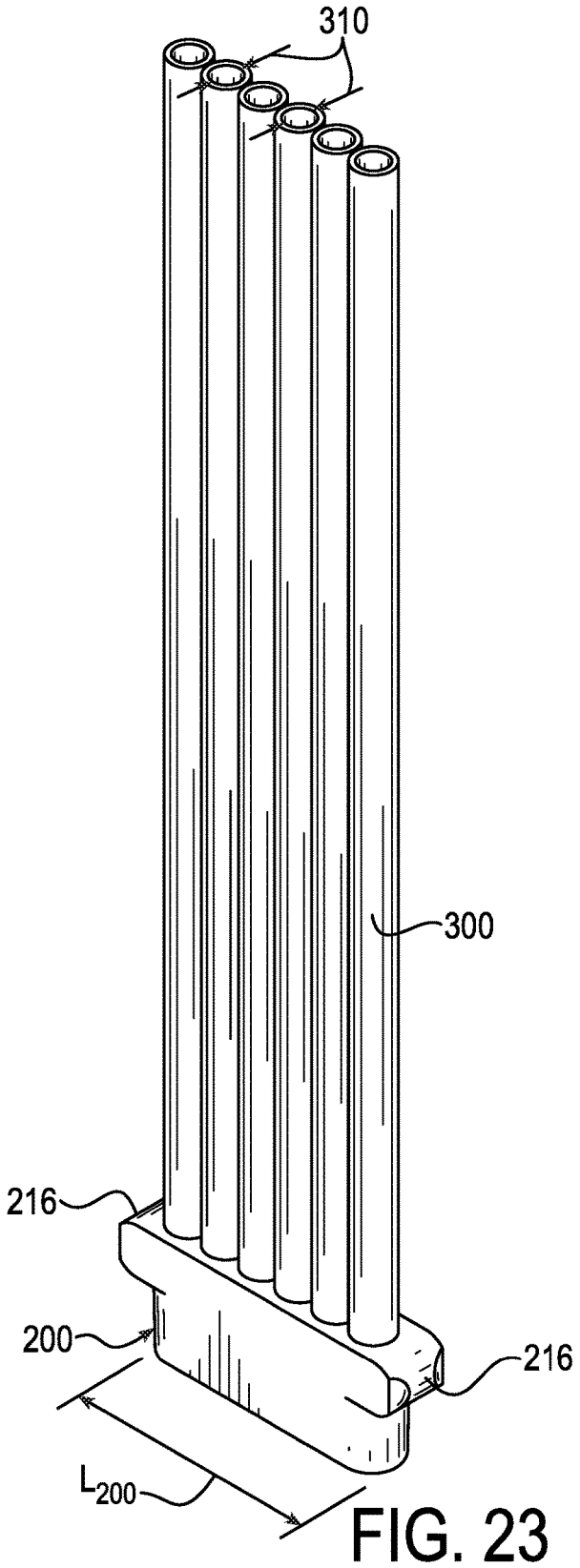
FIG. 23 is a top perspective view of a manifold with tubes of the same interior dimensions, in accordance with an example of the disclosure.
Figure 24:
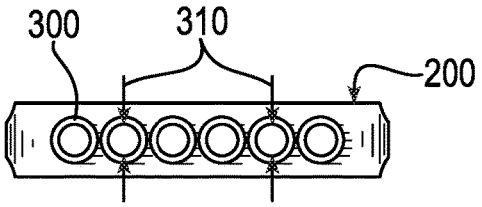
FIG. 24 is a top view of a manifold with tubes of the same interior dimensions, in accordance with an example of the disclosure.
Figure 25:
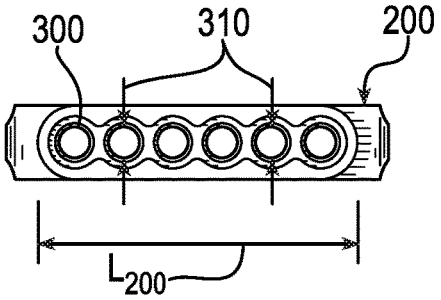
FIG. 25 is a bottom view of a manifold with tubes of the same interior dimensions, in accordance with an example of the disclosure.
Figure 26:
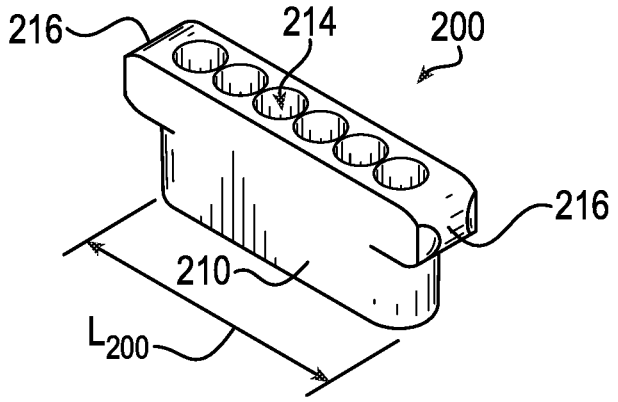
FIG. 26 is a top perspective view of a manifold, in accordance with an example of the disclosure.
Figure 27:
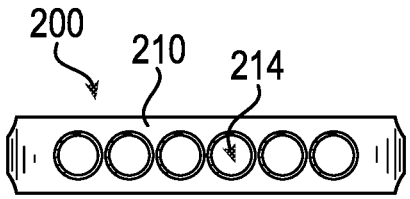
FIG. 27 is a top view of a manifold, in accordance with an example of the disclosure.

FIGS. 13-17 illustrate the manifold 200 of FIGS. 1-6 with the tubes 300 and the mixing nozzle 100 removed for clarity. Likewise, FIGS. 18-22 illustrate the manifold 200 of FIGS. 7-12 with the tubes 300 and illustrating one example of a securing mechanism wherein the mixing nozzle 100 is removed for clarity. FIGS. 23-25 illustrate a manifold 200 of FIGS. 1-6 with tubes 300 having the same interior dimensions. Although not illustrated, a manifold 200 with tubes having the same interior dimensions may also be provided in a manifold having a securing mechanism.

FIGS. 26-29 illustrate a manifold 200 of FIGS. 1-6 with the mixing nozzle 100 and the tubes 300 removed for clarity. Likewise, FIGS. 30-33 illustrate a manifold of FIGS. 7-12 with the mixing nozzle 100 and the tubes 300 removed for clarity and further illustrating one example of a securing mechanism.

FIGS. 34-39 illustrate a mixing nozzle 100 of FIGS. 1-6 with the manifolds 200 removed for clarity. Likewise, FIGS. 40-45 illustrate a mixing nozzle 100 of FIGS. 7-12 with the manifolds 200 removed for clarity and further illustrating one example of a securing mechanism. Each of the above components will now be described, independently and in combination, in greater detail below.

As indicated above, FIGS. 1-6 illustrate an example of a mixing nozzle 100 comprising multiple manifolds 200. Extending from each manifold 200 are one or more tubes 300. The manifold comprises one or more pathways 214 formed into a body 210. Each tube 300 extends into a pathway 214 of the manifold 200 to form a leak-proof connection between the tube 300 and the body 210 of the manifold 200. Because a leak-proof connection is formed, no clamps are required to secure the manifold 200 and the tubes 300 and/or the nozzle 100. In other words, the mixing nozzle 100 is free of any clamp or clamps to secure the tubes 300. This greatly reduces installation time and greatly increases the life of the assembly. In one example, the manifold 200 is overmolded around an end of each of the tubes 300 to form the leak-proof connection between the manifold 200 and each tube 300. In this example, the tubes 300 are permanently secured to the manifold 200. The process of overmolding is discussed in greater detail hereafter. Other types of methods may also form leak-proof connections such as thermal welding, for example.

Figure 1:
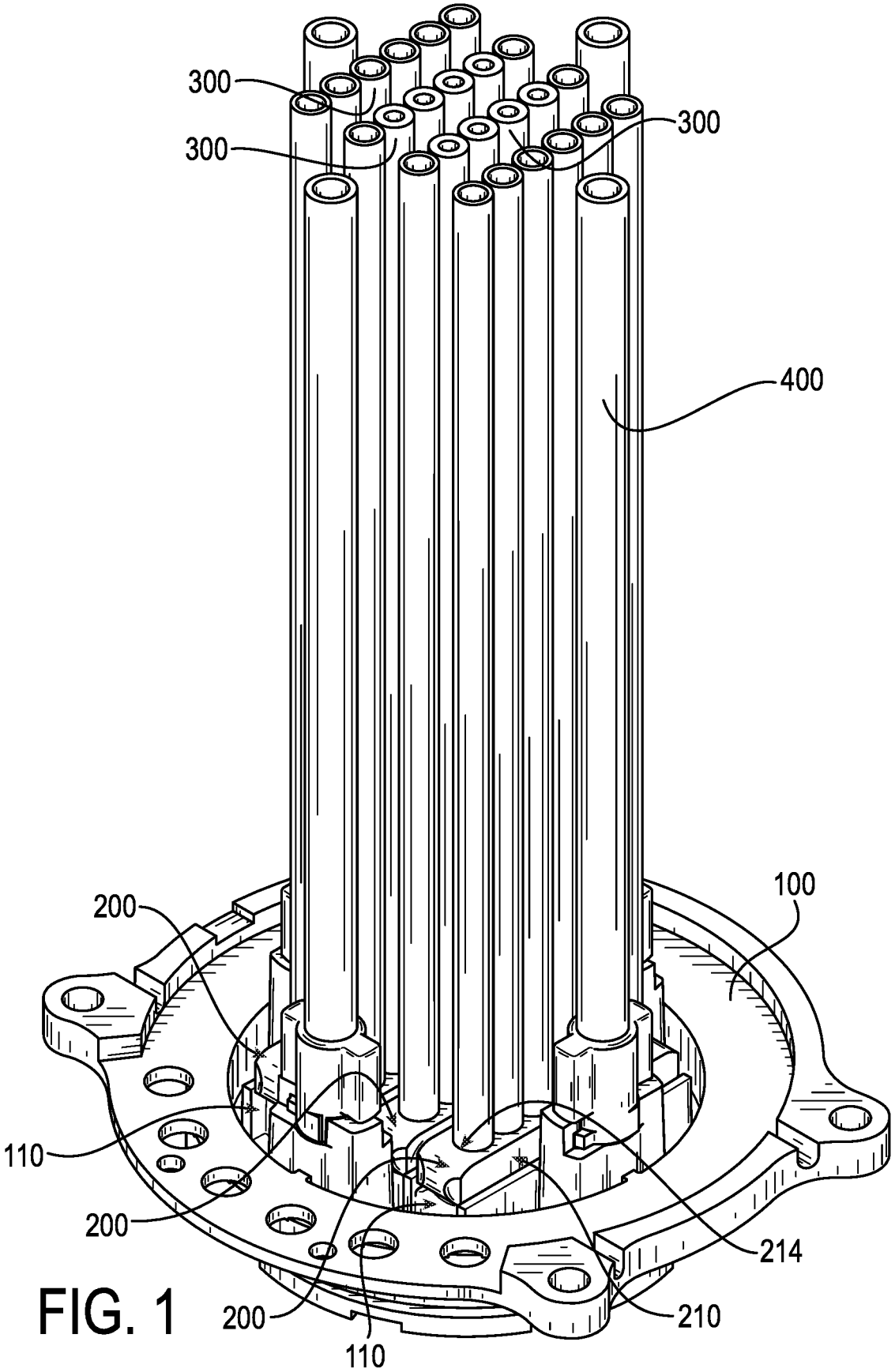
FIG. 1 is a top perspective view of an assembled mixing nozzle, in accordance with an example of the disclosure.

With particular reference to FIG. 1, each manifold 200 is inserted into and secured to a seat 110 of the mixing nozzle 100. As illustrated by FIG. 1 the seat 110 may be formed in the mixing nozzle 100. Alternatively, the seat may be further attached to the mixing nozzle 100. A leak-proof connection is formed between the manifold 200 and the seat 110. In specific examples, the manifold 200 is releasably secured to the seat 110. In the example of FIG. 1, four (4) manifolds 200 are inserted into a respective seat 110 of the mixing nozzle 100. Each manifold 200 comprises six (6) tubes 300, thereby providing twenty-four (24) tubes 300 secured to the mixing nozzle 100 by way of one or more manifolds 200. It is appreciated herein that any number of tubes 300 may be provided on any number of manifolds 200 in the mixing nozzle 100.

Figure 2:
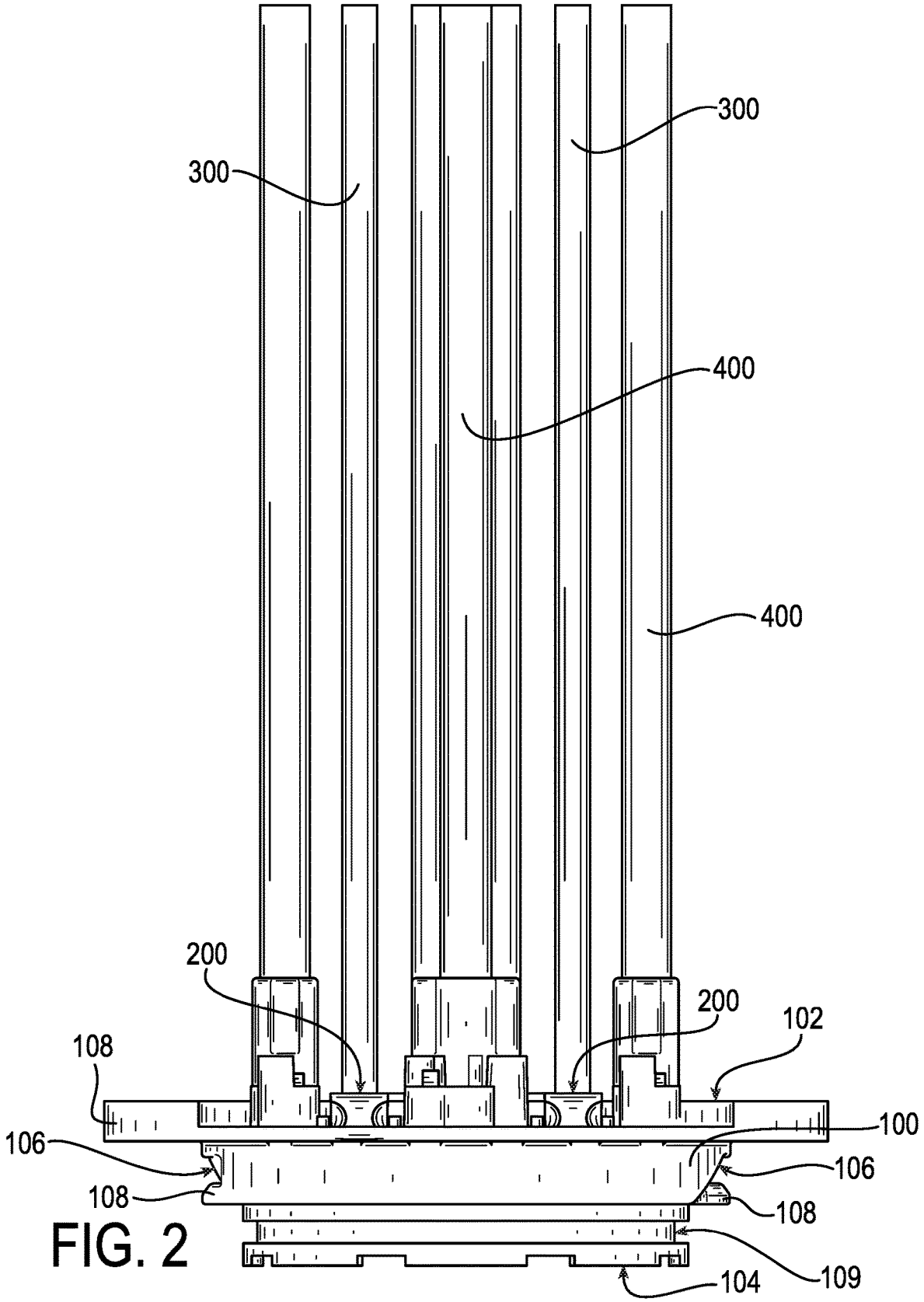
FIG. 2 is a side view of an assembled mixing nozzle, in accordance with an example of the disclosure.
Figure 3:
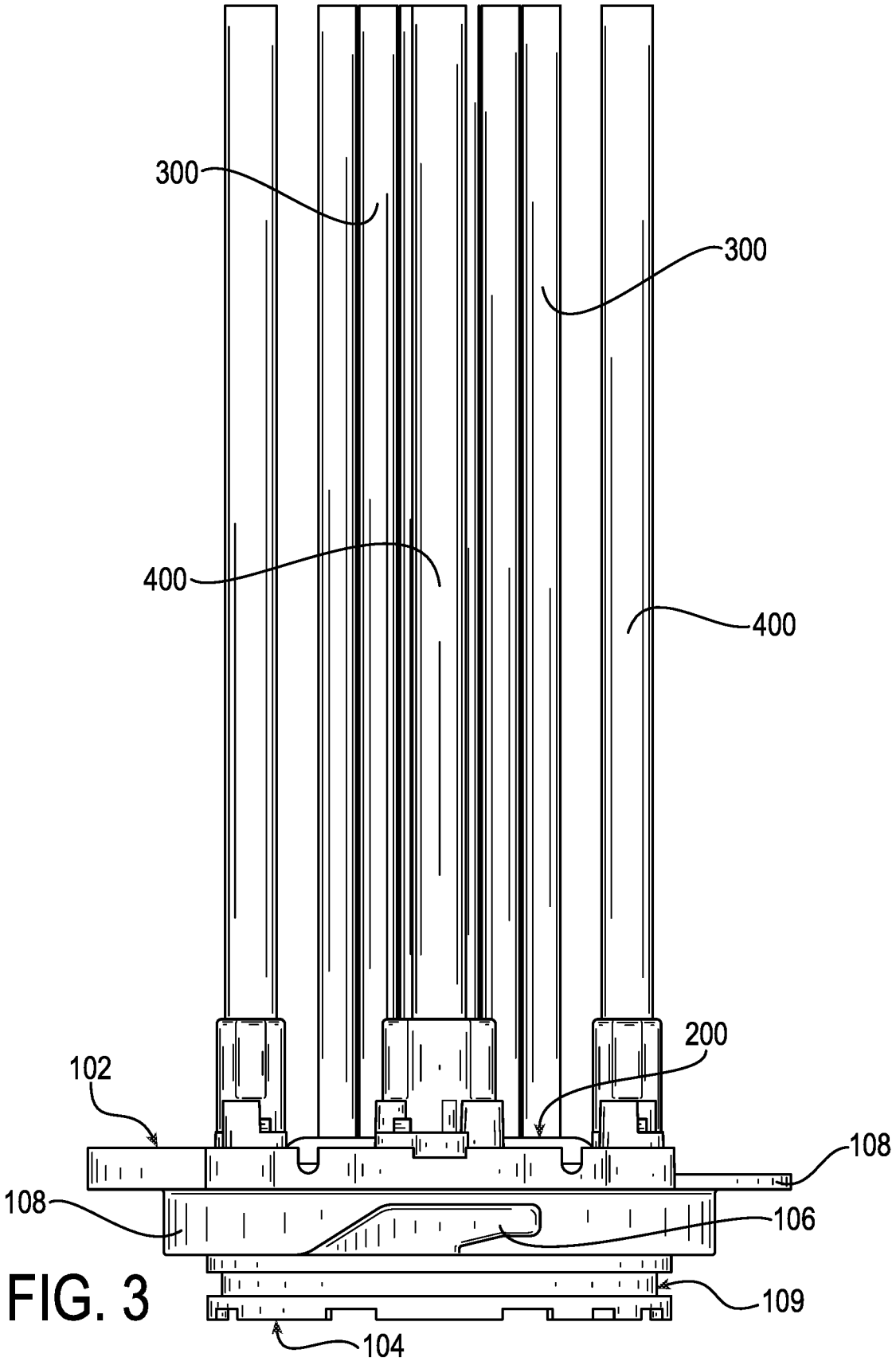
FIG. 3 is a side view of an assembled mixing nozzle, in accordance with an example of the disclosure.

Turning to FIGS. 2-3, side views of the mixing nozzle 100 comprising the manifolds 200 and the tubes 300 are illustrated. The mixing nozzle 100 comprises a top side 102 and a bottom side 104. The top side 102 receives the manifolds 200 and the tubes 300 for receiving the components of the beverage for mixing within the beverage dispensing system. The manifolds 200 (by way of the pathways 214) and the tubes 300 extending through each manifold 200 are open through the bottom side 104 of the mixing nozzle 100 where they allow the mixture of the beverage-making contents within the beverage dispensing system. The mixing nozzle 100, the manifolds 200, and the tubes 300 facilitate flow and distribution into the beverage dispensing system. In the example of FIGS. 1-6 the pathways 214 and tubes 300 are aligned in a single row along the length $L_{200}$ of the body of the manifold 200. In other examples, several rows of pathways 214 for accommodating several rows of tubes 300 may be provided in a single manifold 200.

As illustrated by the side views of FIGS. 2-3, the mixing nozzle 100 comprises various attachment structures for mating with and securing the mixing nozzle 100 to the beverage dispensing system. Such attachment structures may include a threaded sleeve 106 and/or various lips and ledges 108 for forming a leak-proof connection between the mixing nozzle 100 and the beverage dispensing system to which it attaches to. In one particular example, a quarter-turn mating connection may be provided at the nozzle to mate with the beverage dispensing system and provide a leak-proof connection there between. Moreover, the mixing nozzle 100 may also comprise a perimeter slot 109 for providing a gasket between the mixing nozzle 100 and the beverage dispensing system to provide such a leak-proof connection.

Figure 4:
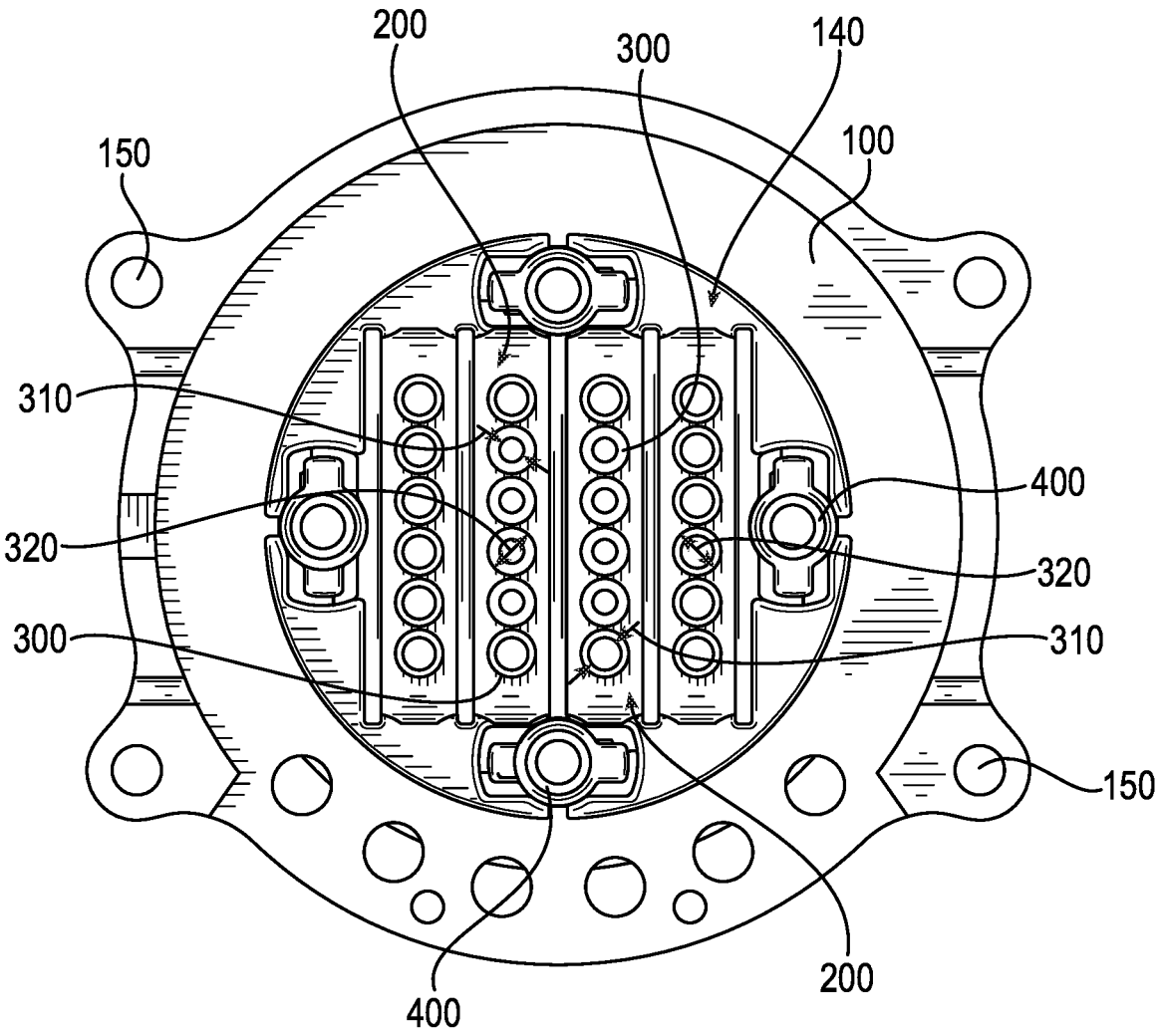
FIG. 4 is a top view of an assembled mixing nozzle, in accordance with an example of the disclosure.

As illustrated by FIG. 4, the manifolds 200 are placed in a side-by-side arrangement within a central section 140 of the mixing nozzle 100. Additional tubes, such as water tubes 400, may be attached by other means at other locations of the mixing nozzle as later described. The water tubes 400 may carry water and/or carbonated water. By example, in FIGS. 2-4, the water tubes 400 are provided at the perimeter of the central section 140 of the mixing nozzle 100. The water tubes 400 and their connection to the mixing nozzle 100 are discussed in greater detail below.

Figure 15:
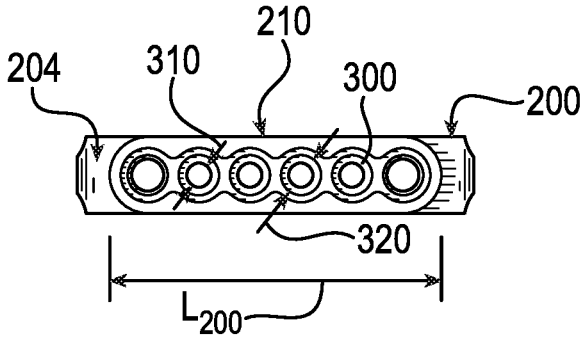
FIG. 15 is a bottom view of a manifold with tubes of varying interior dimensions, in accordance with an example of the disclosure.

FIG. 4 displays a top view of the mixing nozzle 100. In this view, the manifolds 200 are aligned in their side-by-side arrangement with tubes 300 evenly distributed and placed within the central section 140 of the mixing nozzle 100 where the seats 110 (as illustrated by FIG. 1) are provided. The tubes 300 may be aligned parallel or substantially parallel to each other in the direction along the length $L_{200}$ of manifold 200 when viewed from the top view or bottom view of the manifold 200, as shown in FIG. 15 for example. The manifolds may be aligned parallel or substantially parallel to each other in the direction along the length $L_{200}$ of manifold 200 when viewed from the top view or bottom view of the mixing nozzle 100, as shown in FIG. 4 for example. Four water tubes 400 are evenly distributed about the perimeter of the central section 140 as shown. In this example, the water tubes 400 are located 90 degrees apart from one another along the perimeter of the central section 140, as viewed in FIG. 4 for example. However, the water tubes 400 may be distributed in other orientations.

Figure 5:
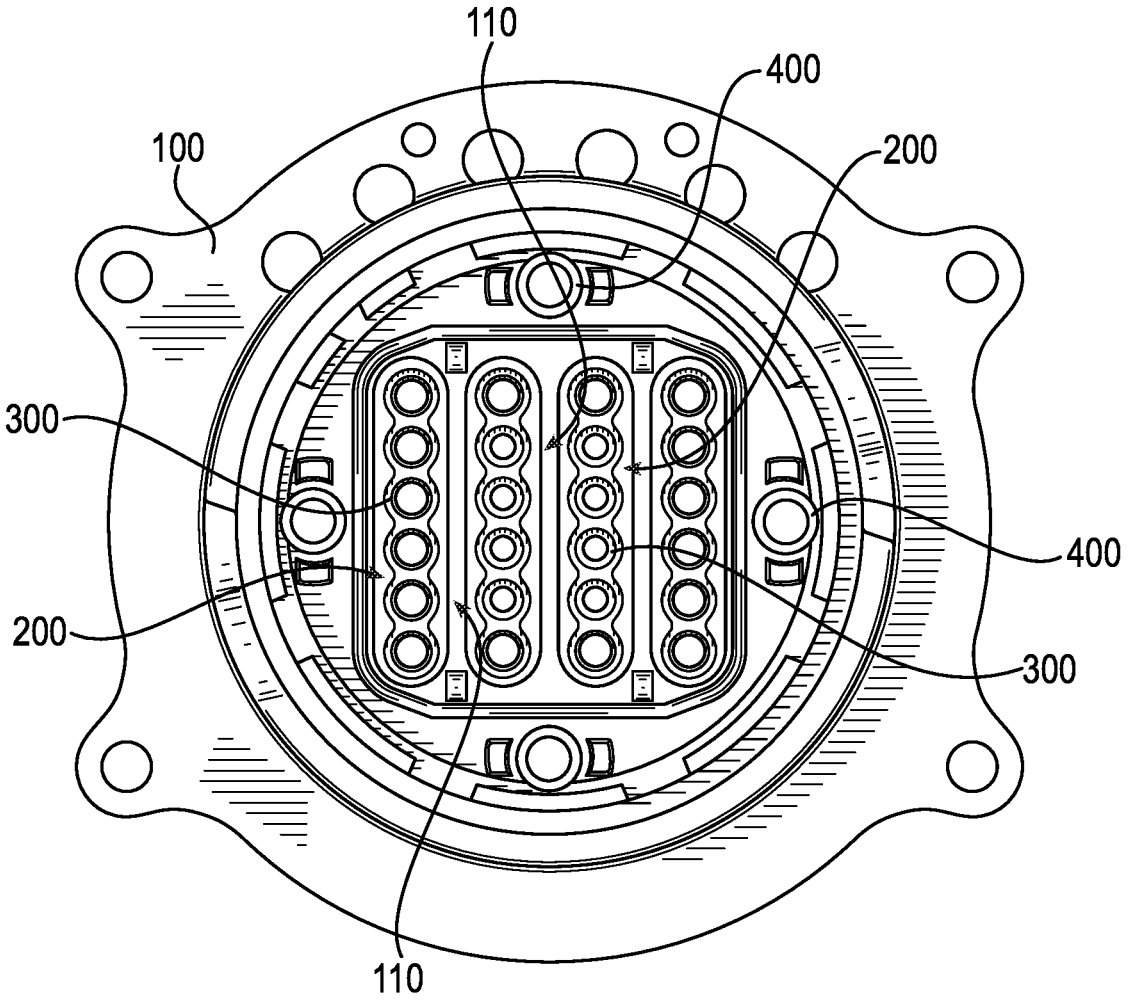
FIG. 5 is a bottom view of an assembled mixing nozzle, in accordance with an example of the disclosure.
Figure 6:
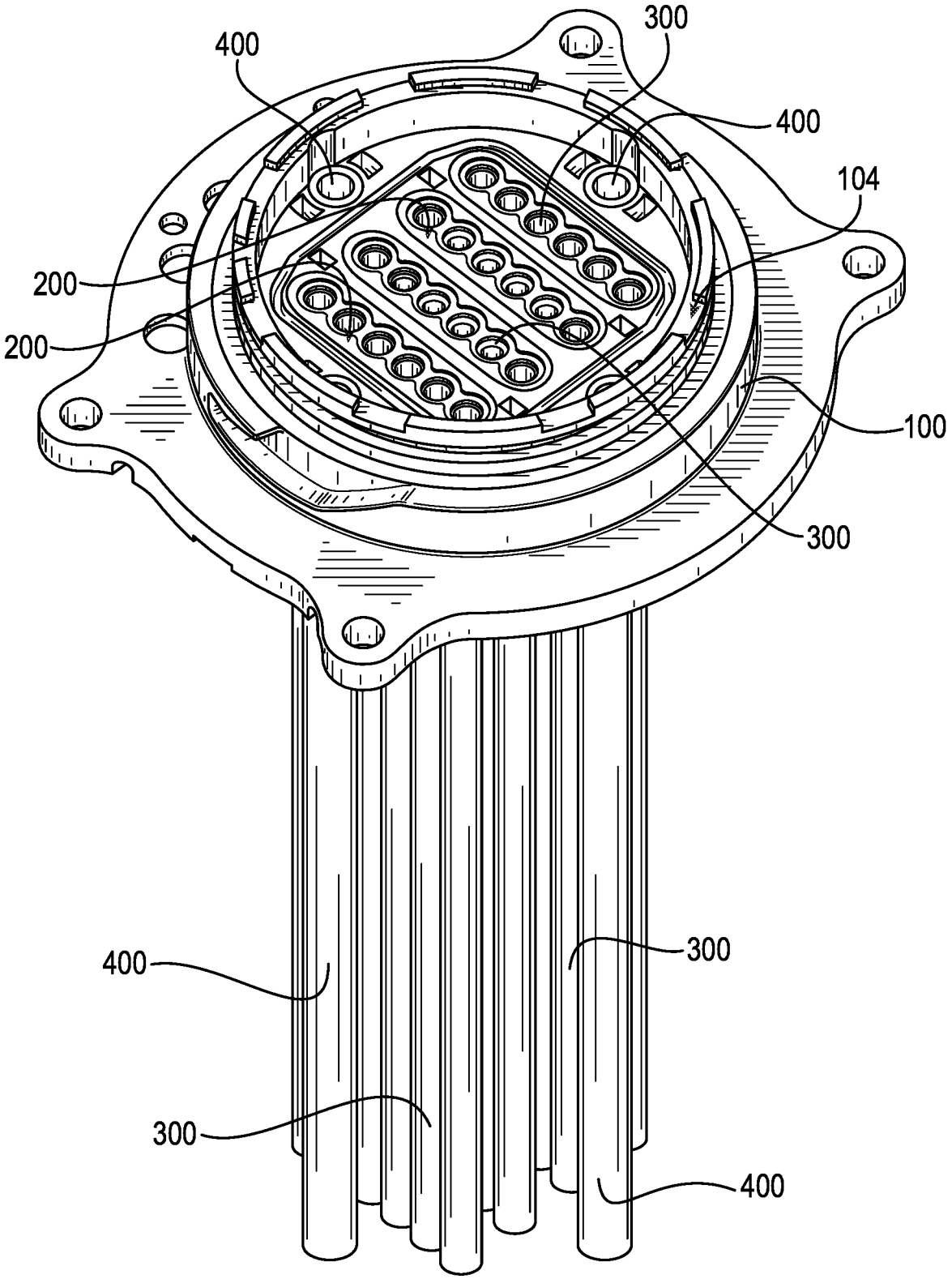
FIG. 6 is a bottom perspective view of an assembled mixing nozzle, in accordance with an example of the disclosure.

As also illustrated by the top side 102 view of the mixing nozzle in FIG. 4, the tubes 300 may comprise different interior diameters 310 in their cross section based on the wall thickness of each tube 300. However, in this particular example, the tubes 300 maintain a consistent exterior diameter 320 in their cross section. By maintaining a consistent exterior diameter 320, continuity in manufacturing (including using the same molds and molding process) may be maintained even though different interior diameter 310 tubes 300 are produced. The only change needed to be made in the molding process would be to change the size of the core pin to match the interior diameter 310 of the respective tube 300 during the molding process. Also, as illustrated by the top side 102 view of FIG. 4, additional attachment means may be provided on the mixing nozzle 100, such as openings 150 for attaching fasteners and for securing the mixing nozzle 100 to the beverage dispensing system. In some examples, aside from these openings, as well as openings to the exterior of the beverage dispensing system, the manifolds 200, by way of the tubes 300, and/or the water tubes 400 provide the only pathways 214 through the mixing nozzle 100 into an interior of the beverage dispensing system for mixing the beverage components. This is additionally illustrated by a bottom side 104 view of the mixing nozzle 100, as illustrated by FIG. 5, where the manifolds 200 having their respective tubes 300 are positioned within their respective seats 110. Also, FIG. 5 illustrates the water tubes 400 extending through the mixing nozzle 100 to the bottom side 104 (as illustrated in FIGS. 2-3) of the mixing nozzle 100. FIG. 6 further illustrates a perspective view from the bottom side 104 of the mixing nozzle 100 comprising the manifolds 200, tubes 300, and water tubes 400 as described above.

Figure 7:
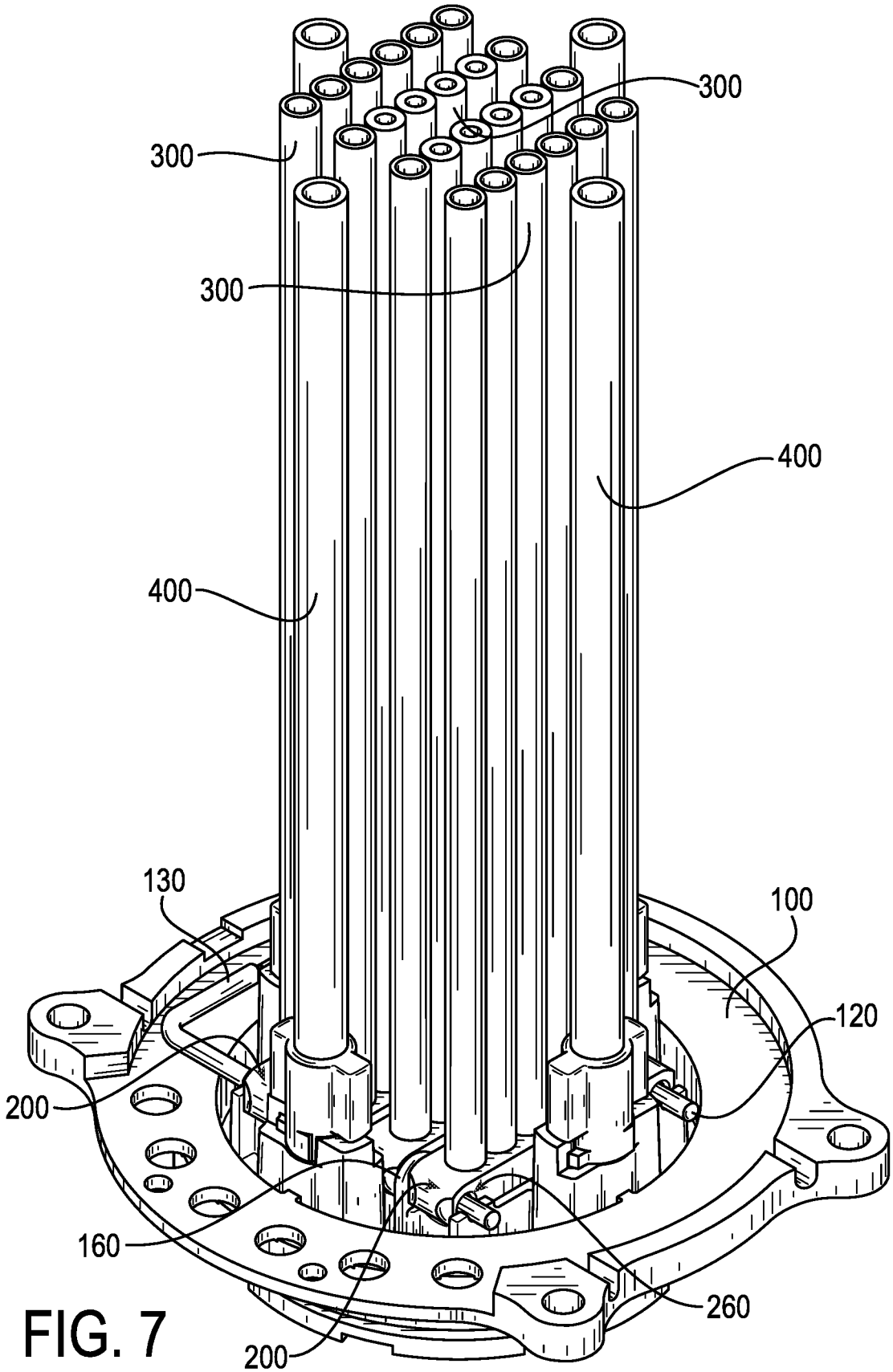
FIG. 7 is a top perspective view of an assembled mixing nozzle having a securing mechanism, in accordance with an example of the disclosure.
Figure 8:
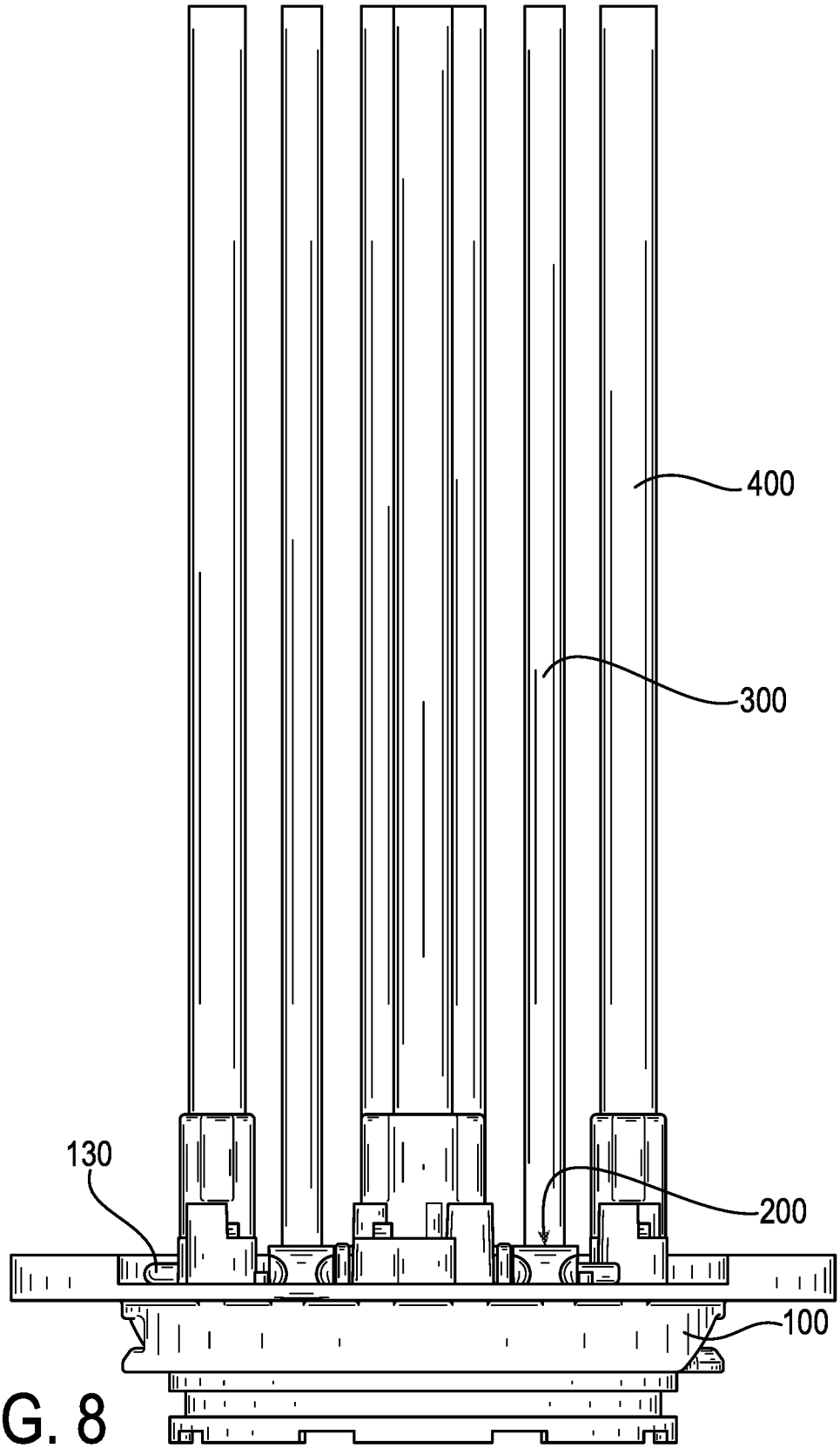
FIG. 8 is a side view of an assembled mixing nozzle having a securing mechanism, in accordance with an example of the disclosure.
Figure 9:
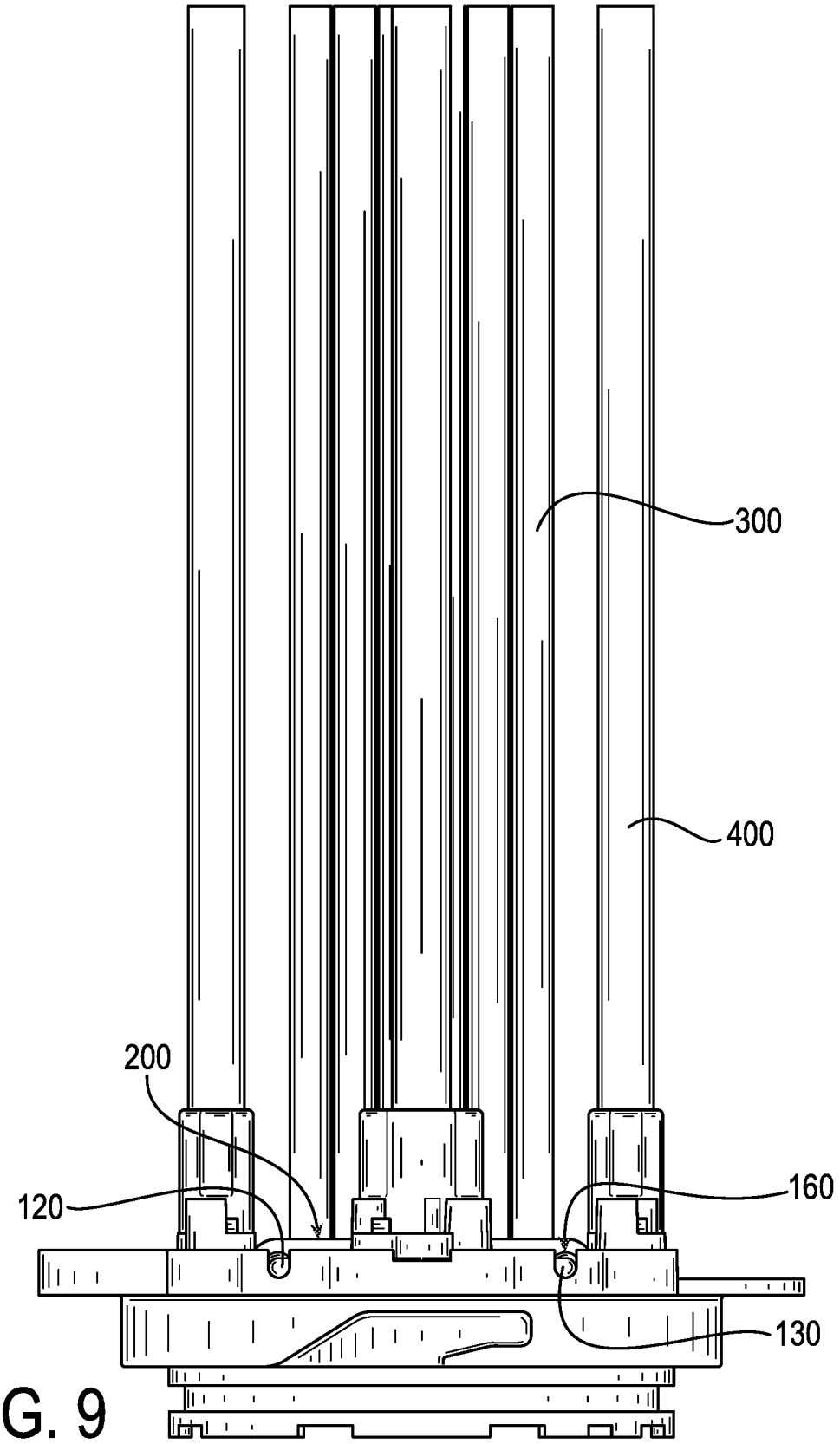
FIG. 9 is a side view of an assembled mixing nozzle having a securing mechanism, in accordance with an example of the disclosure.

Turning now to FIGS. 7-12, another example of the mixing nozzle 100 comprising manifolds 200, tubes 300, and water tubes 400 is provided. This particular example is the same as the example as described with respect to FIGS. 1-6, above, with the addition of one or more securing pins 120, 130 to illustrate an example of a securing mechanism. Alternative securing mechanisms are also contemplated herein. As illustrated by FIG. 7, a first securing pin 120 and a second securing pin 130 are provided. The securing pins 120, 130 each extend through one or more mixing nozzle pin openings 160 attached to, formed into, and/or molded into the mixing nozzle 100. The securing pins 120, 130 further extend through manifold pin openings 260 attached to, formed into, and/or molded into the manifolds 200. When the manifold 200 is positioned within its respective seat 110, the mixing nozzle pin openings 160 align with the manifold pin openings 260. As best illustrated by the top side 102 view of FIG. 10, the manifold pin openings 260 are provided near each lateral end 220, 230 of each manifold 200, with the tubes 300 therebetween. By inserting the securing pins 120, 130 and mating the securing pins 120, 130 through the mixing nozzle pin openings 160 and the manifold pin openings 260, each manifold 200 is forced into and/or secured in its respective seat 110. In the example of FIGS. 7-12 two securing pins 120, 130 are provided at opposing ends 220, 230 of the manifolds 200 where the securing pins 120, 130 are relied on to secure each of the manifolds 200 to the mixing nozzle 100. In other examples, a single securing pin 120 or 130 may be provided. By example, a single securing pin 120 or 130 may comprise two entry ends for securing opposing sides of each respective manifold 200. In yet another example, a single securing pin 120 or 130 may be provided centrally within a manifold 200 to secure the manifold 200. In still yet other examples, additional pins may be provided, by example, wherein each manifold 200 is secured to the mixing nozzle 100 independent of an adjacent manifold 200. Aside from the securing mechanism, FIGS. 7-12 maintain the same features as illustrated and described with respect to FIGS. 1-6.

Figure 10:
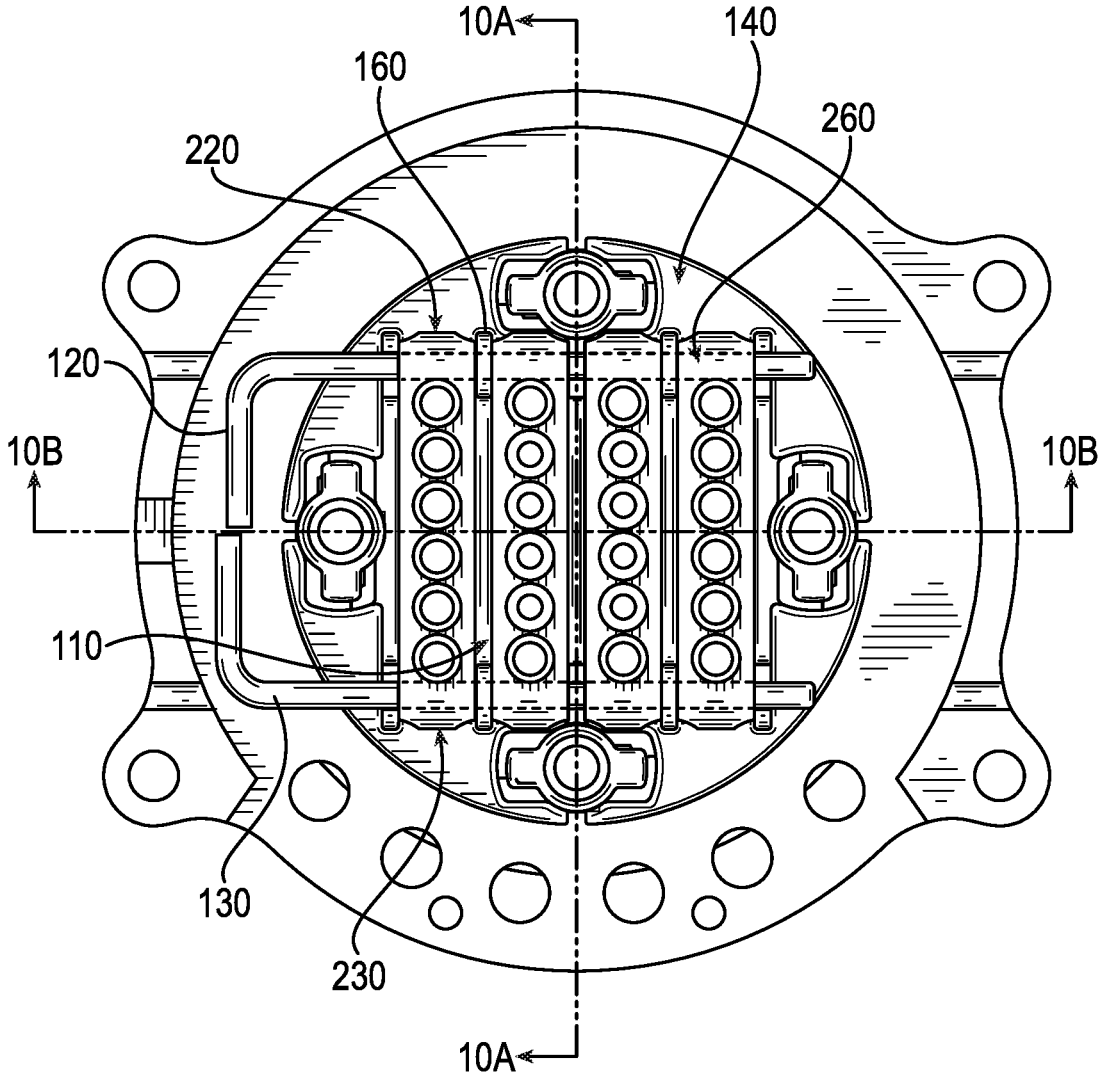
FIG. 10 is a top view of an assembled mixing nozzle having a securing mechanism, in accordance with an example of the disclosure.
Figure 10A:
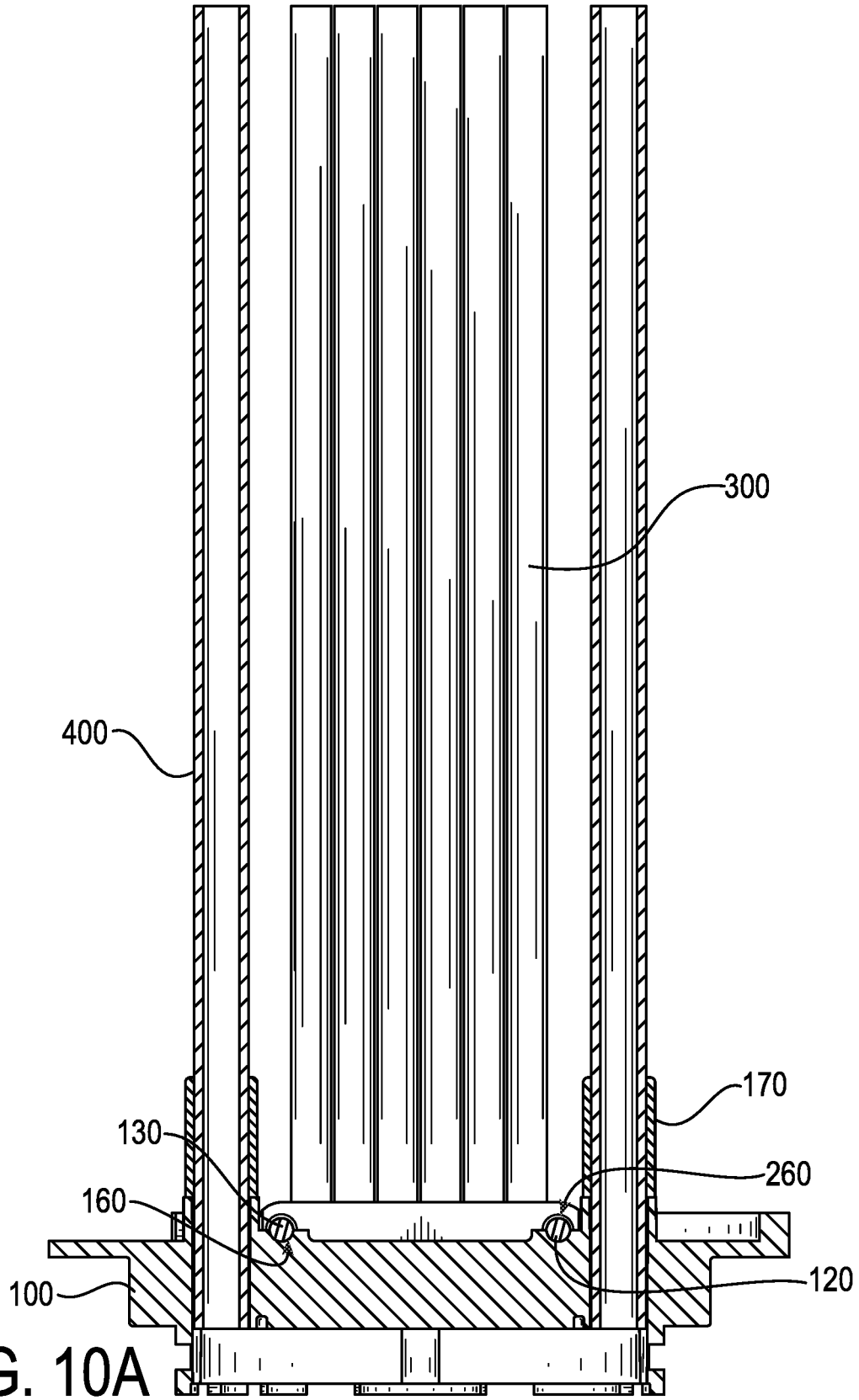
FIG. 10A is a cross-sectional view of an assembled mixing nozzle taken along line 10A-10A of FIG. 10, in accordance with an example of the disclosure.
Figure 10B:
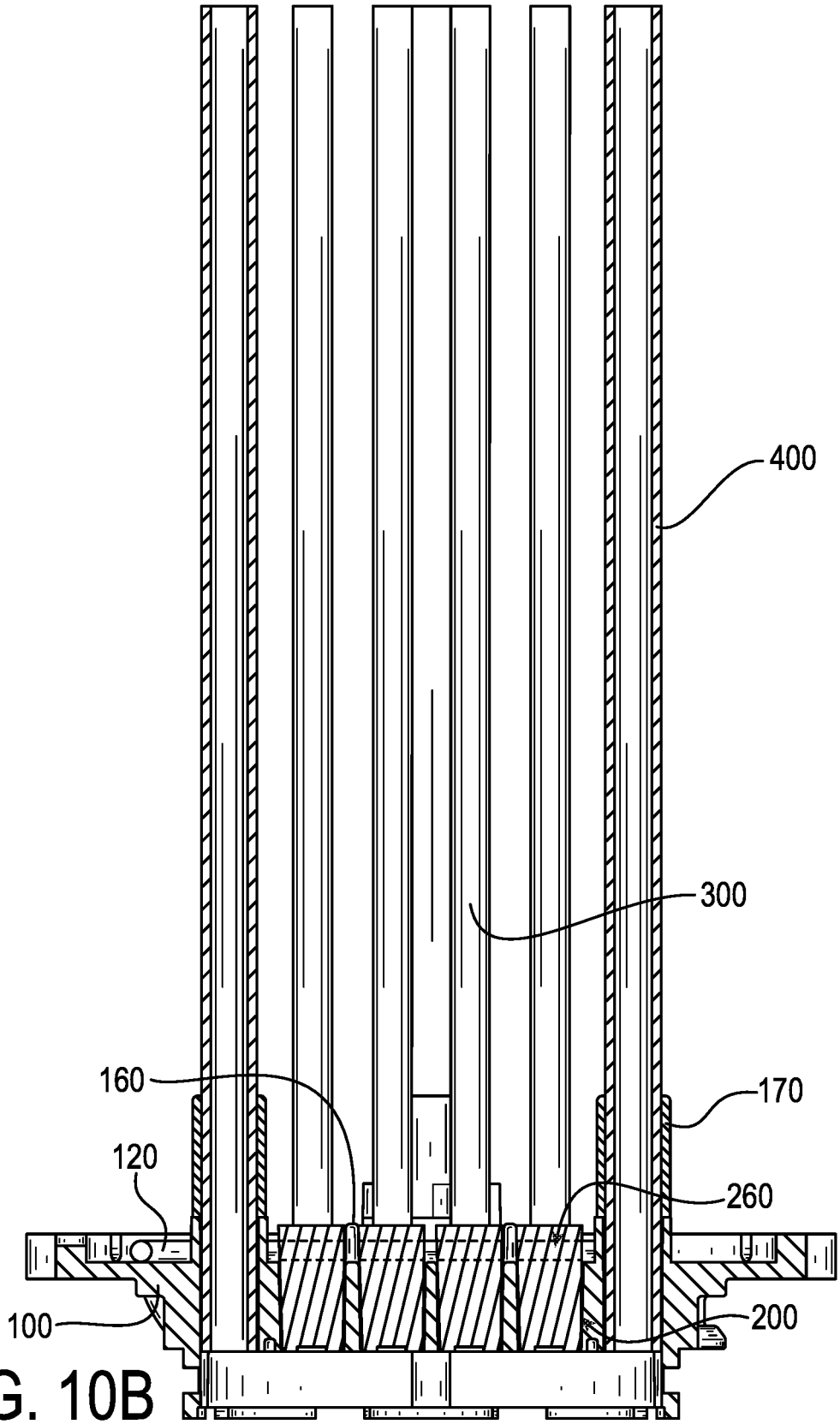
FIG. 10B is a cross-sectional view of an assembled mixing nozzle taken along line 10B-10B of FIG. 10, in accordance with an example of the disclosure.
Figure 11:
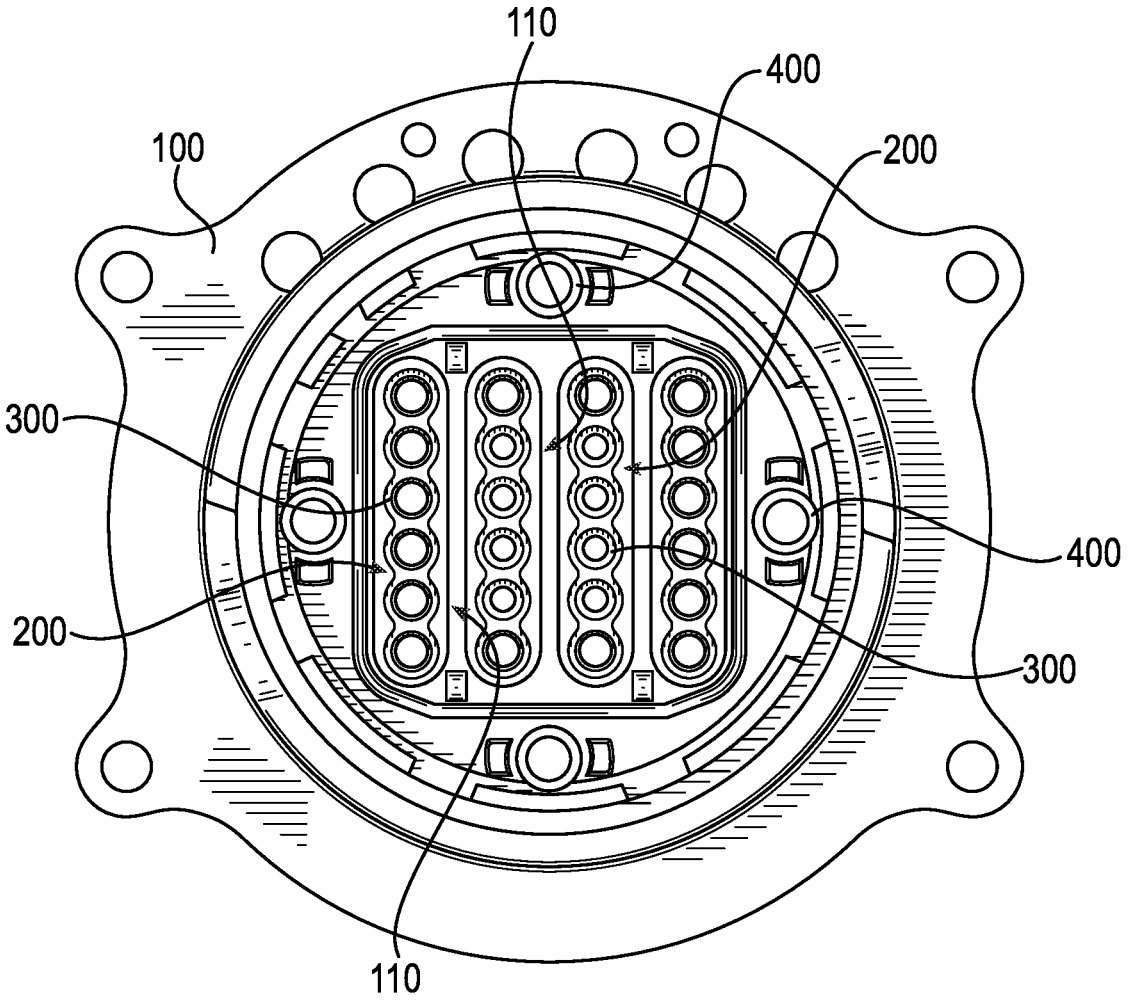
FIG. 11 is a bottom view of an assembled mixing nozzle having a securing mechanism, in accordance with an example of the disclosure.
Figure 12:
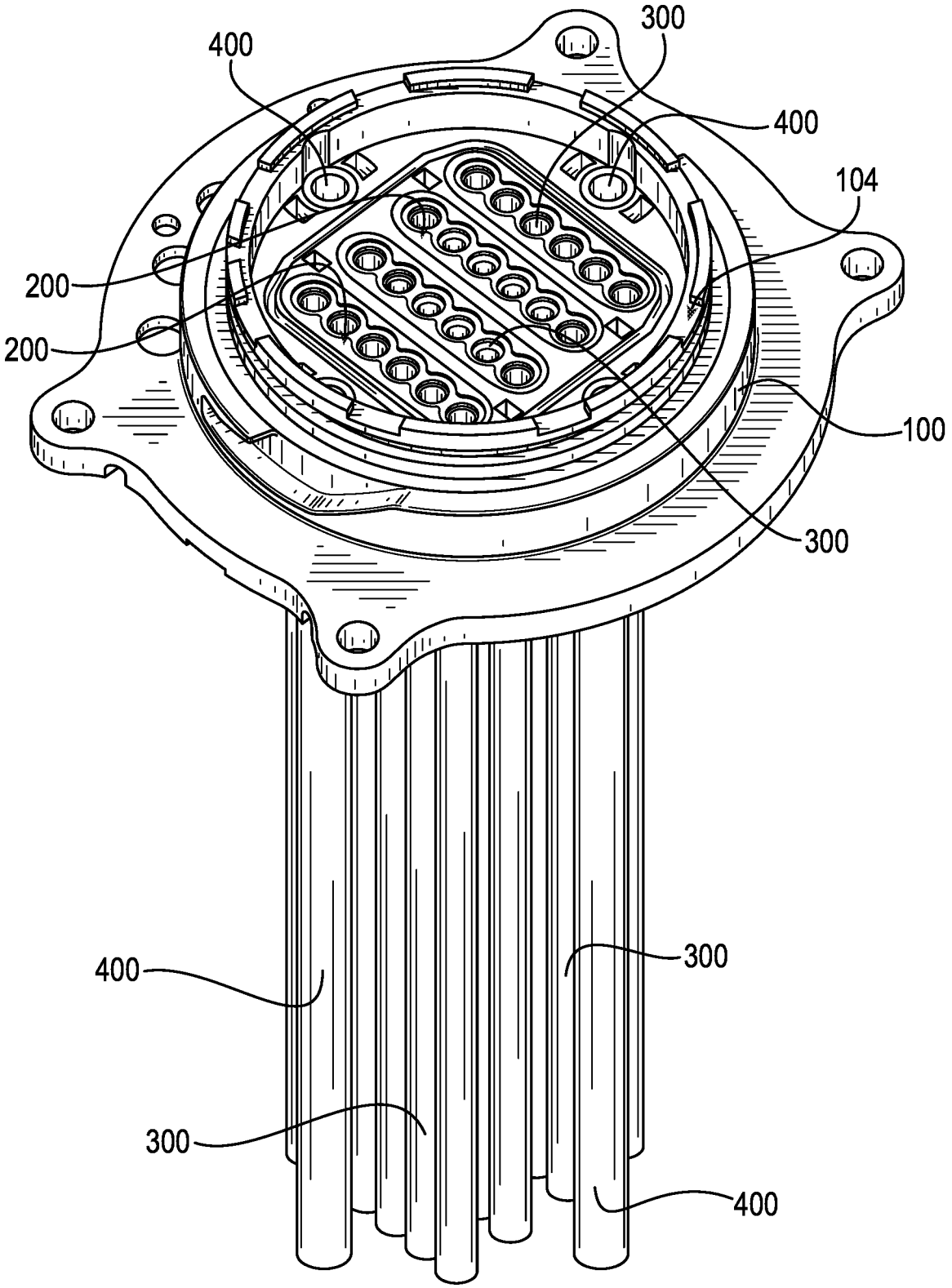
FIG. 12 is a bottom perspective view of an assembled mixing nozzle having a securing mechanism, in accordance with an example of the disclosure.
Figure 13:
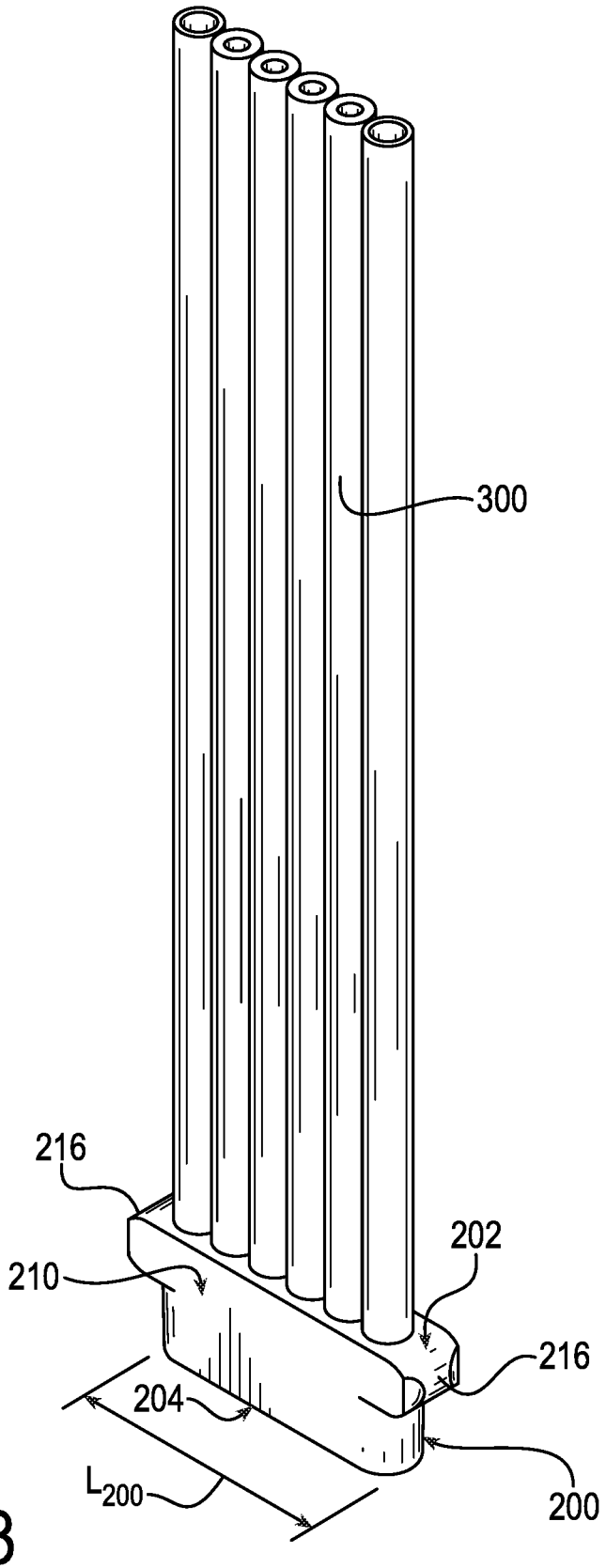
FIG. 13 is a top perspective view of a manifold with tubes of varying interior dimensions, in accordance with an example of the disclosure.

Turning now to FIGS. 10A-10B, cross-sectional views of the assembled mixing nozzle 100 are illustrated. In FIG. 10A, taken at line 10A-10A of FIG. 10, the cross-sectional view illustrates the mixing nozzle 100 bisected between manifolds 200. In this example, the securing pins 120, 130 extend through the manifold pin openings 260 and additionally rest on mixing nozzle pin openings 160. Also illustrated are the water tubes 400 positioned in their respective water tube fittings 170. In FIG. 10B, taken at line 10B-10B of FIG. 10, the cross-sectional view illustrates the mixing nozzle 100 bisecting the manifolds 200 between tubes 300. In this example, each manifold 200 is secured to a seat 110 of the mixing nozzle 100. In this example, one securing pin 120 is illustrated as extending through a manifold pin opening 260 at one end of each manifold 200. The securing pin 120 additionally extends through mixing nozzle pin openings 160. Like in FIG. 10A, water tubes 400 are additionally positioned in their respective water tube fitting 170.

Figure 14:
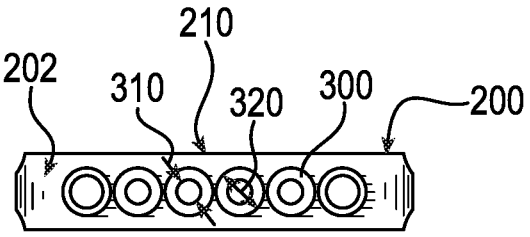
FIG. 14 is a top view of a manifold with tubes of varying interior dimensions, in accordance with an example of the disclosure.
Figure 16:
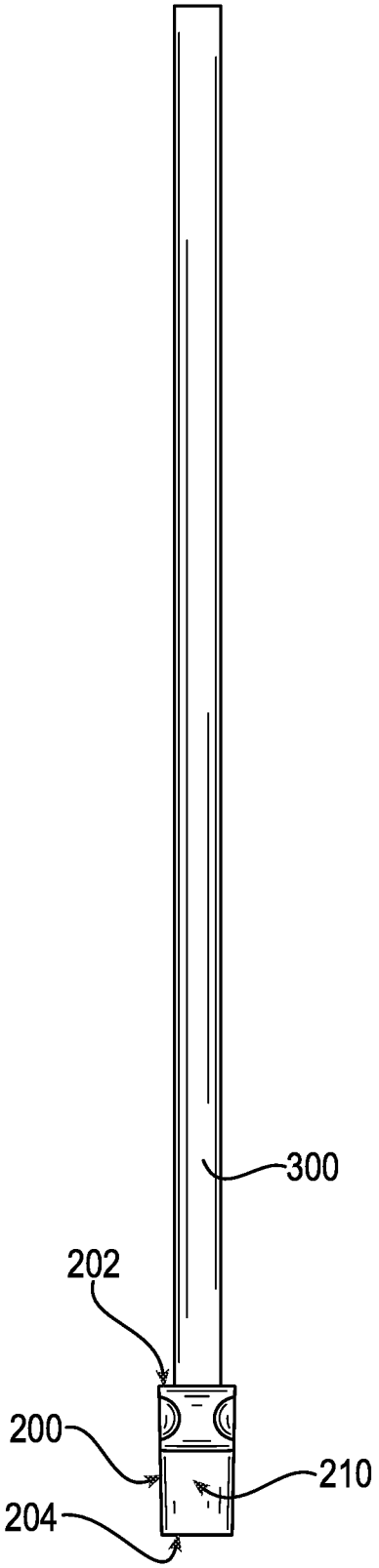
FIG. 16 is an end view of a manifold with tubes, in accordance with an example of the disclosure.
Figure 17:
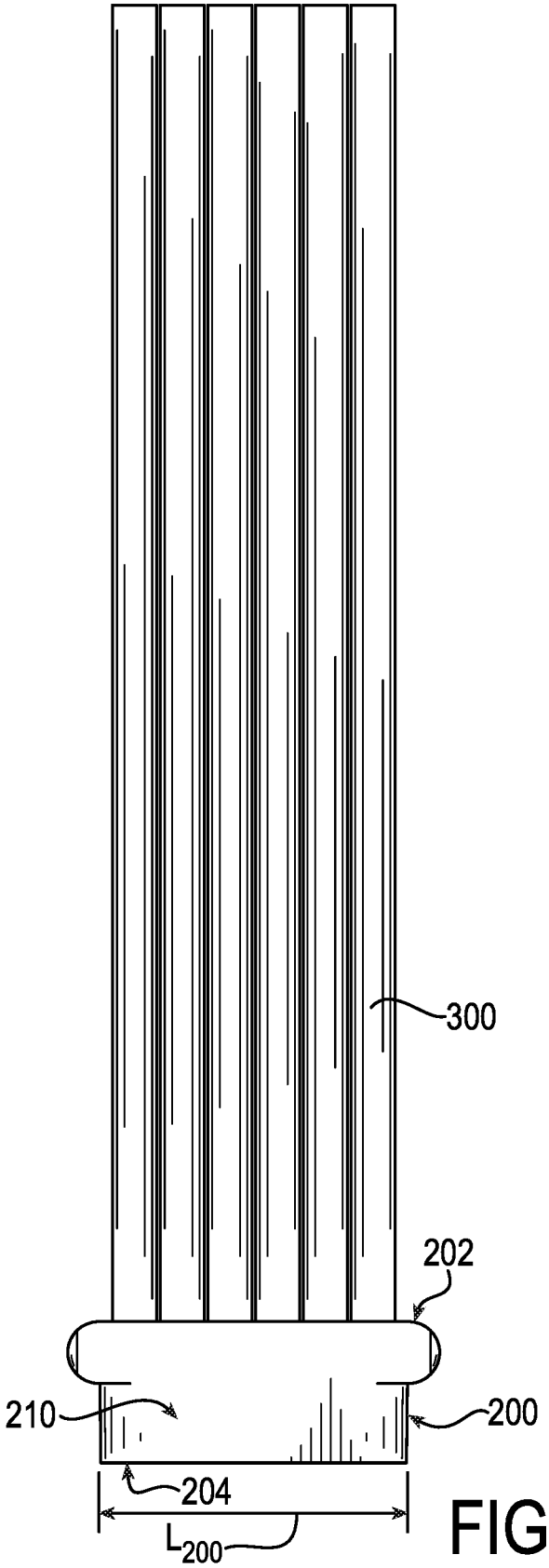
FIG. 17 is a side view of a manifold with tubes of varying interior dimensions, in accordance with an example of the disclosure.

FIGS. 13-17 illustrate the manifold 200 of FIGS. 1-6 which has been removed from the mixing nozzle 100 for clarity. Illustrated by FIG. 13, the tubes 300 extend into the body 210 of the manifold 200 forming a leak-proof connection between the manifold 200 and the tubes 300 without clamps. The tubes 300 also extend away from a top side 202 of the body 210. In other words, an end of each tube 300 extends into the manifold, where the other end of the tube 300 connects to a beverage component source as described further herein. The top side 202 of a manifold 200 is illustrated in FIG. 14. The tubes 300 may fully extend through the body 210 of the manifold or may partially extend through the body 210 of the manifold 200. As illustrated by a bottom side 204 of the body 210 of the manifold in FIG. 15, the tubes 300 extend partially through the body 210 of the manifold 200 but terminate at a recess 212 (FIG. 28) prior to the bottom side 204 of the body 210 of the manifold 200 in this particular example. The recess 212 is further described later in the application. The opposing ends of the tubes 300 (opposite the terminating ends in the manifold), may extend to a beverage component source, such as a water line, a carbonated water line, a syrup line, a concentrate, or the like. These opposing tube ends may be connected to the beverage component source by any of the connections described herein or contemplated in the art including, but not limited to, a quarter-turn connection, a cam connection, a clamp, an overmold, a barb and/or the like. As illustrated by both the top side 202 view and the bottom side 204 view in FIGS. 14-15 respectively, the tubes 300 may comprise different interior diameters 310 while maintaining similar exterior diameters 320, as described above. Different interior diameters 310 may help further control the amount of the beverage component source being dispensed. It is appreciated herein that the tubes 300 may, additionally or alternatively, comprise different exterior diameters 320. FIG. 16 and FIG. 17 illustrate an end view and a side view, respectively, having the same features as described with respect to FIGS. 13-15 but at a different perspective.

Figure 18:
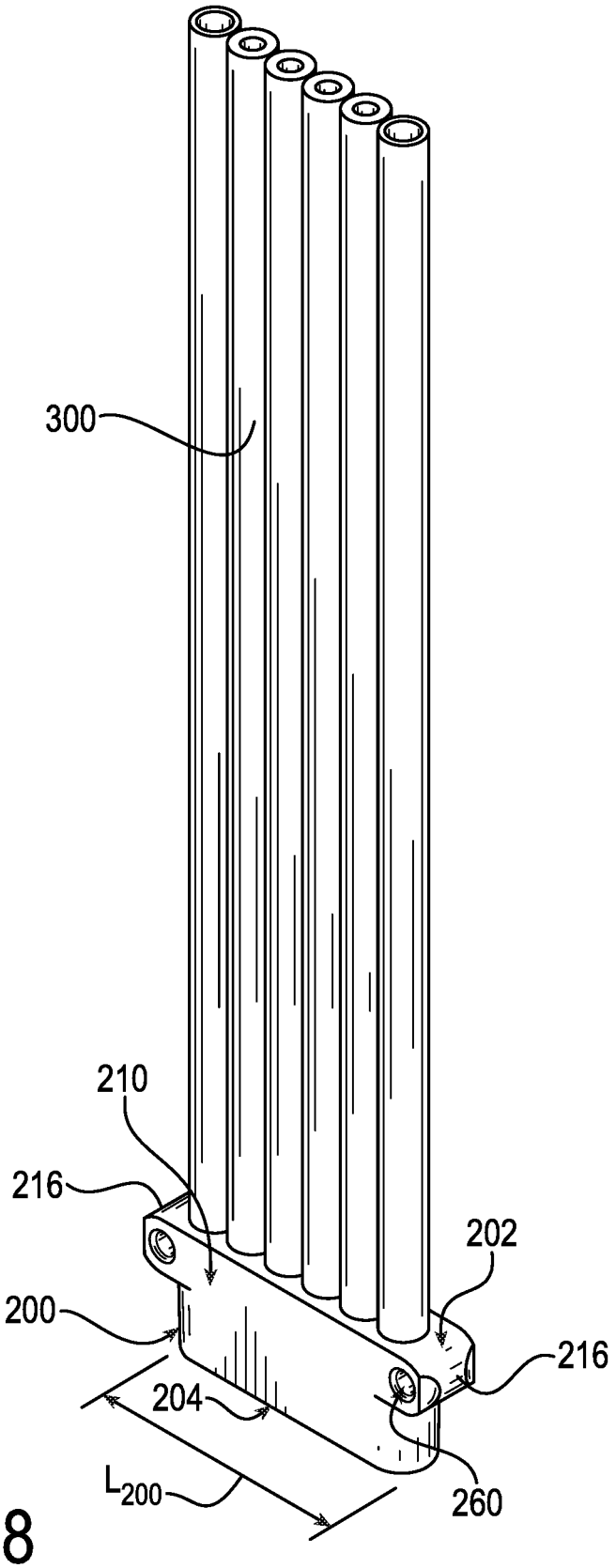
FIG. 18 is a top perspective view of a manifold with tubes of varying interior dimensions and having a securing mechanism, in accordance with an example of the disclosure.
Figure 19:
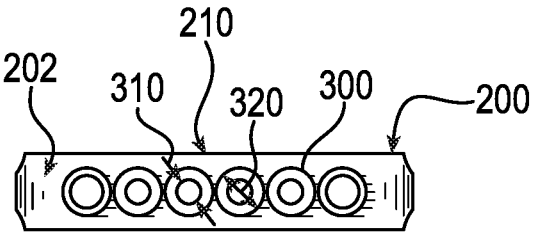
FIG. 19 is a top view of a manifold with tubes of varying interior dimensions and having a securing mechanism, in accordance with an example of the disclosure.
Figure 20:
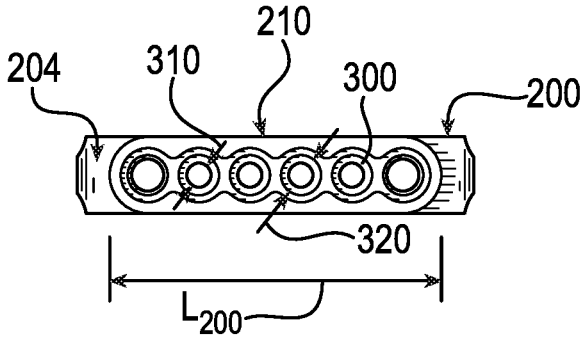
FIG. 20 is a bottom view of a manifold with tubes of varying interior dimensions and having a securing mechanism, in accordance with an example of the disclosure.
Figure 21:
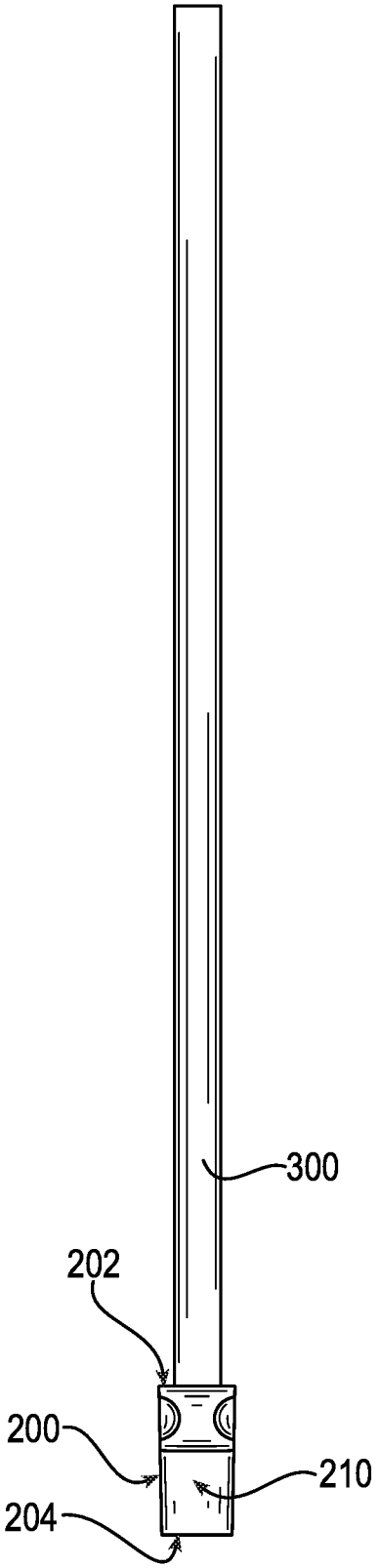
FIG. 21 is an end view of a manifold with tubes and having a securing mechanism, in accordance with an example of the disclosure
Figure 22:
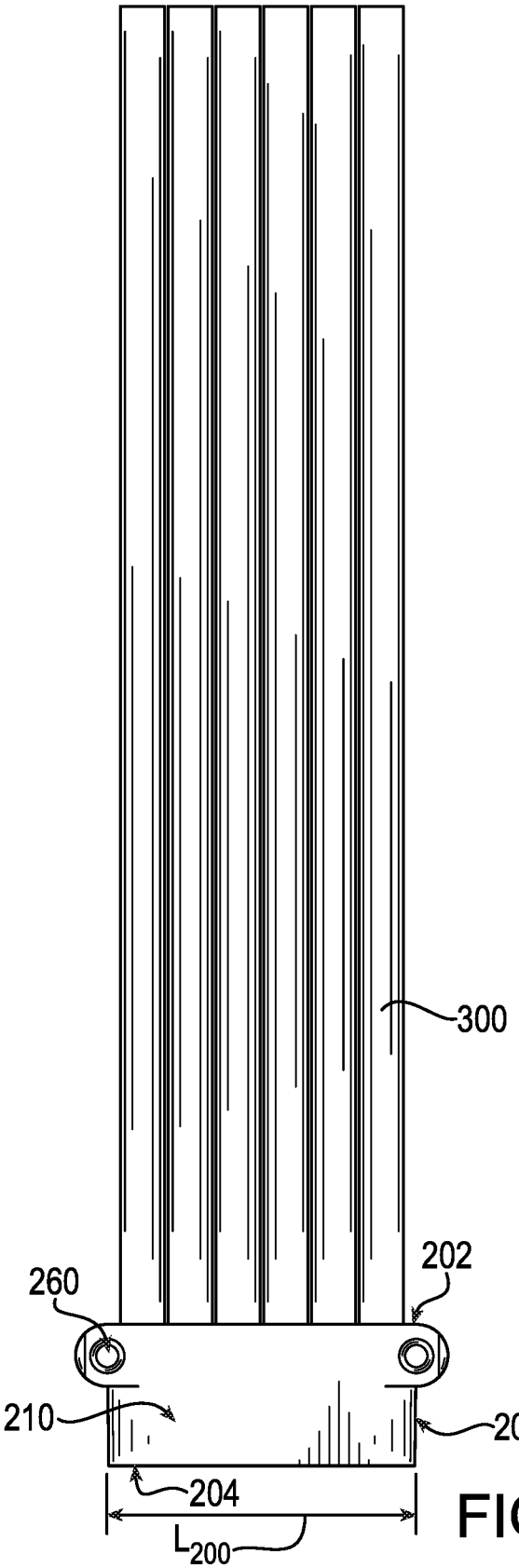
FIG. 22 is a side view of a manifold with tubes of varying interior dimensions and having a securing mechanism, in accordance with an example of the disclosure.

Comparatively, FIGS. 18-22 illustrate the manifold 200 comprising the tubes 300 with a securing mechanism for receiving the securing pins 120, 130 as shown in FIGS. 7-12. The manifold 200 of this example comprise the pin openings 260 extending through the body 210 of the manifold 200. In this particular example, the pin openings 260 extend through each respective shoulder 216 of the manifold 200 in a direction perpendicular to the direction of the tubes 300 as shown in FIGS. 18 and 22. Aside from the securing mechanism, FIGS. 18-22 maintain the same features as described with respect to FIGS. 13-17.

FIGS. 23-25 illustrate a manifold 200 comprising tubes 300 in the same manner as FIGS. 13-17. The only difference is that FIGS. 23-25 illustrate a manifold 200 comprising tubes 300 wherein the inside diameter 310 of each of the tubes 300, in a respective manifold 200, are the same. It is appreciated herein that the inside diameters 310 of the tubes 300 may be the same across one manifold 200, may be different across one manifold 200, may be different between manifolds 200, or any combination thereof.

Figure 28:
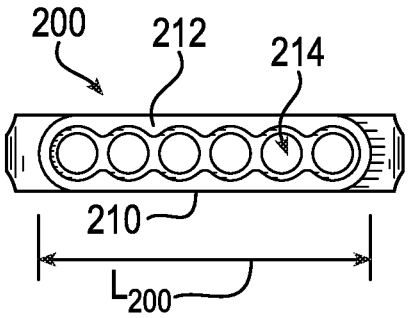
FIG. 28 is a bottom view of a manifold, in accordance with an example of the disclosure.
Figure 29:
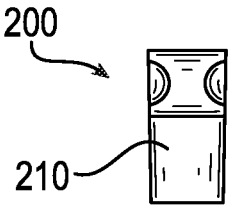
FIG. 29 is an end view of a manifold, in accordance with an example of the disclosure.
Figure 30:
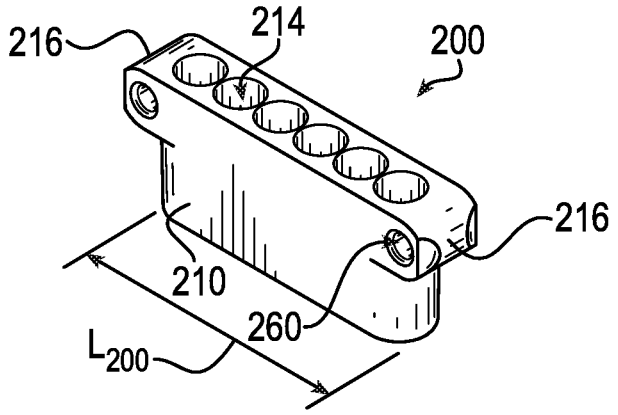
FIG. 30 is a top perspective view of a manifold having a securing mechanism, in accordance with an example of the disclosure.
Figure 31:
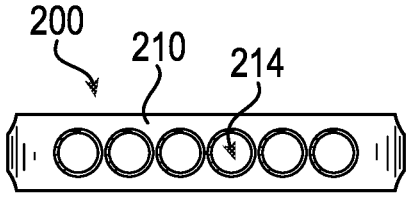
FIG. 31 is a top view of a manifold having a securing mechanism, in accordance with an example of the disclosure.
Figure 32:
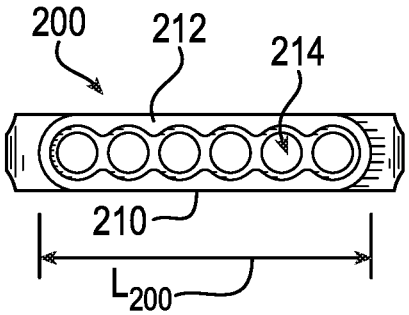
FIG. 32 is a bottom view of a manifold having a securing mechanism, in accordance with an example of the disclosure.
Figure 33:
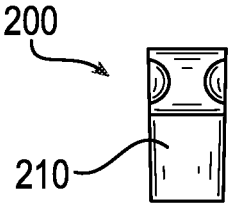
FIG. 33 is an end view of a manifold having a securing mechanism, in accordance with an example of the disclosure.

FIGS. 26-29 illustrate a manifold 200 without the tubes 300. As illustrated by FIG. 28 the body 210 of the manifold may further comprise a recess 212 at the bottom of the tubes 300. In some examples, the recess 212 is for accepting a gasket material. The gasket material may be overmolded onto the mating component of the beverage dispensing system prior to connecting the manifold 200 to the beverage dispensing system. The manifold provides multiple pathways 214 for the multiple tubes 300. The pathways 214 of the manifold may be the same dimension, thereby, accommodating a consistent tube exterior diameter 320. Alternatively, the pathways 214 may be different dimensions or of a combination of dimensions in order to accommodate a variety of tubes 300 having differing exterior diameters 320. Comparatively, FIGS. 30-33 also illustrate a manifold 200 without the tubes 300 in the body, as described with respect to FIGS. 26-29, and further illustrating an example of a securing mechanism, i.e. the pin openings 260 as described with respect to FIGS. 7-12.

Although the manifold 200 illustrates six pathways 214 in FIGS. 26-29 and FIGS. 30-33, it is appreciated that the manifold 200 may only have a need for five (or fewer) pathways and tubes 300 depending on the specific application. In order to reduce the number of pathways 214 in the manifold 200, the same mold may still be used by placing a blank core pin in the mold where the pathway 214 is desired to be removed. The blank core pin will allow the pathway 214 to be sealed or closed during the molding process. Each pathway 214 to be sealed will require a separate blank core pin.

Figure 34:
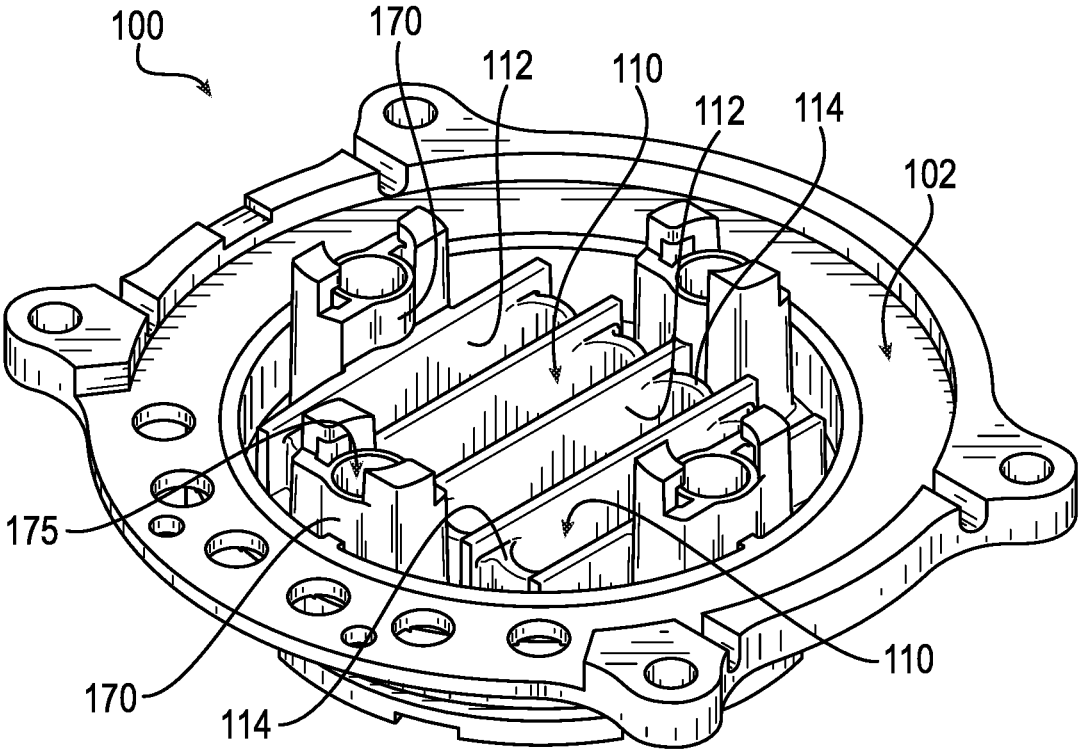
FIG. 34 is a top perspective view of a mixing nozzle, in accordance with an example of the disclosure.
Figure 35:
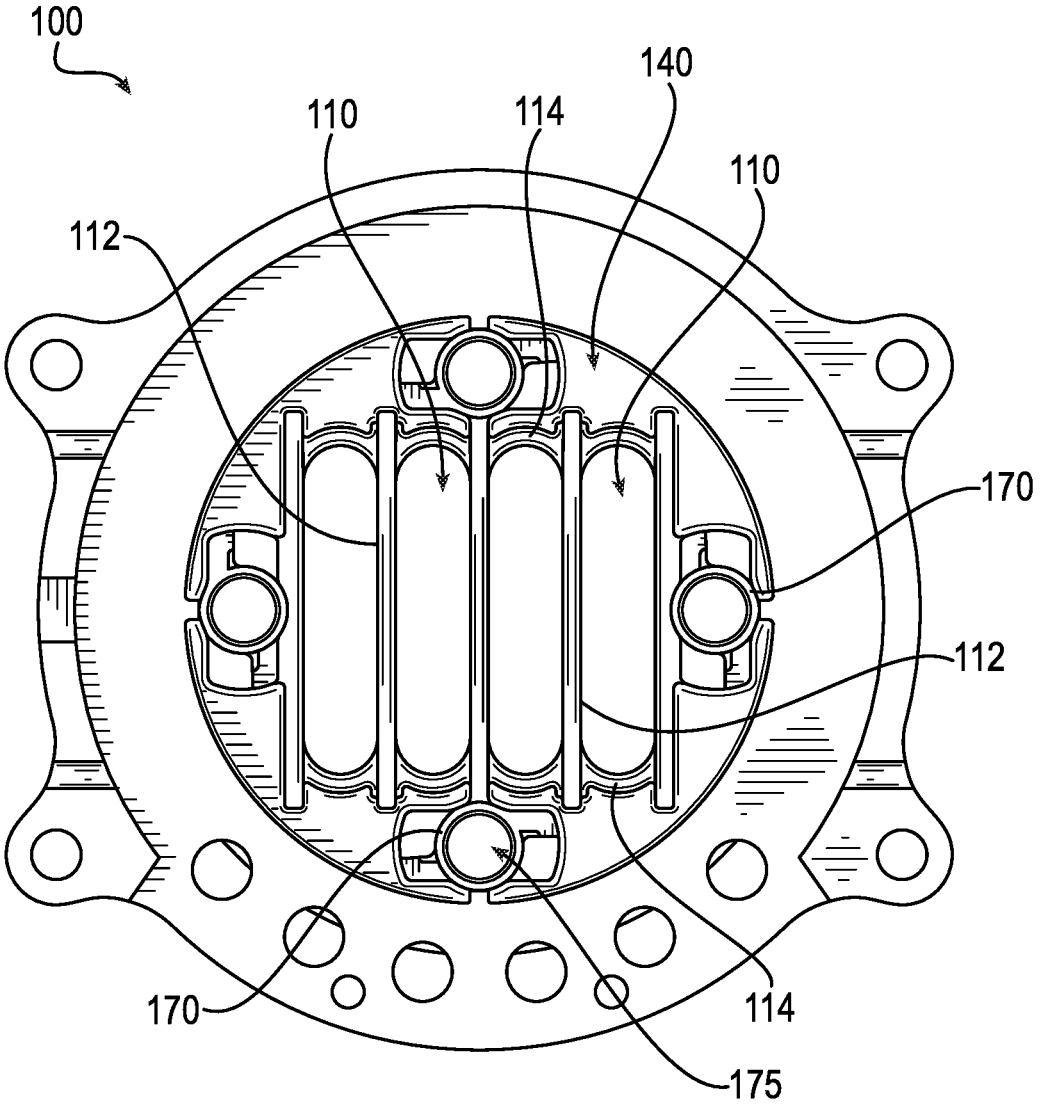
FIG. 35 is a top view of a mixing nozzle, in accordance with an example of the disclosure.

Turning now to FIGS. 34-39, a mixing nozzle 100, separate from the manifolds 200 and tubes 300, is illustrated. In FIG. 34, the mixing nozzle 100 comprises multiple seats 110 for receiving multiple manifolds. The seats 110 may be formed in the mixing nozzle 100, as illustrated by FIGS. 34-39. Alternatively, the seat 110 may be attached to the mixing nozzle 100. As shown in FIG. 34, each seat 110 includes side walls 112 that separate each seat 110 from one another, where adjacent seats 110 share a sidewall 112. The seats 110 include a profile matching the profile of the bottom of each manifold 200 in order to properly seat the manifolds 200 in the seats 110. In this example, the profile oval-shaped, but could be any number of shapes. As shown in FIGS. 34 and 35, for example, the seats 110 may further include opposing shoulder walls 114 having a height shorter than the height of the sidewalls 112. The opposing shoulder walls 114 act as a stop when the manifold 200 is fully inserted into the seat 110 and the shoulders 216 of the manifold 200 contact the respective shoulder walls 114 to ensure proper engagement. A leak-proof connection is formed between the manifold 200 and the seat 110 when the manifold 200 is secured in its respective seat 110. In specific examples, the manifold 200 is releasably secured to the seat 110. However, it is also contemplated that the manifolds 200 may be permanently secured to the seat 110 by way of fusion welding, a press fit or other known means in the art. In the example of FIGS. 34-39, four (4) manifolds 200 are capable of being inserted into a respective seat 110 of the mixing nozzle 100.

Figure 36:
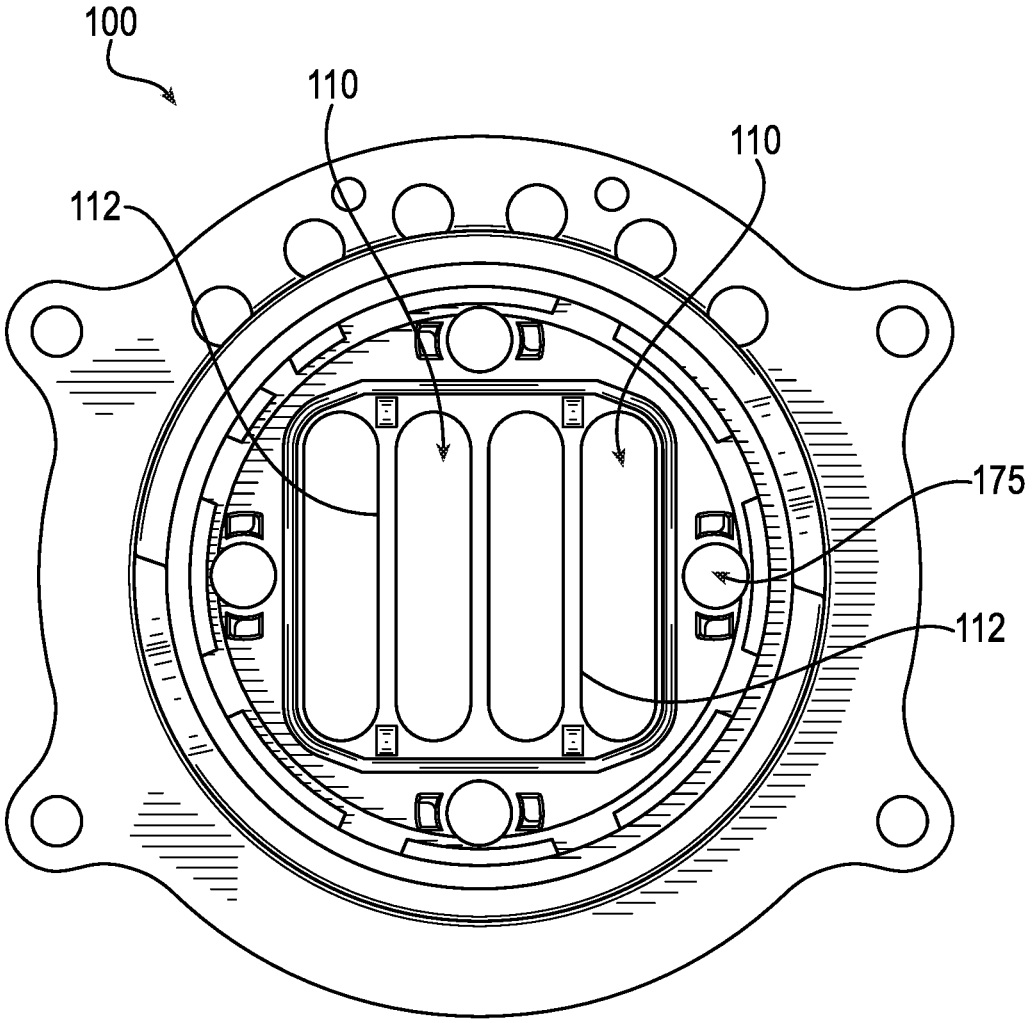
FIG. 36 is a bottom view of a mixing nozzle, in accordance with an example of the disclosure.
Figure 37:
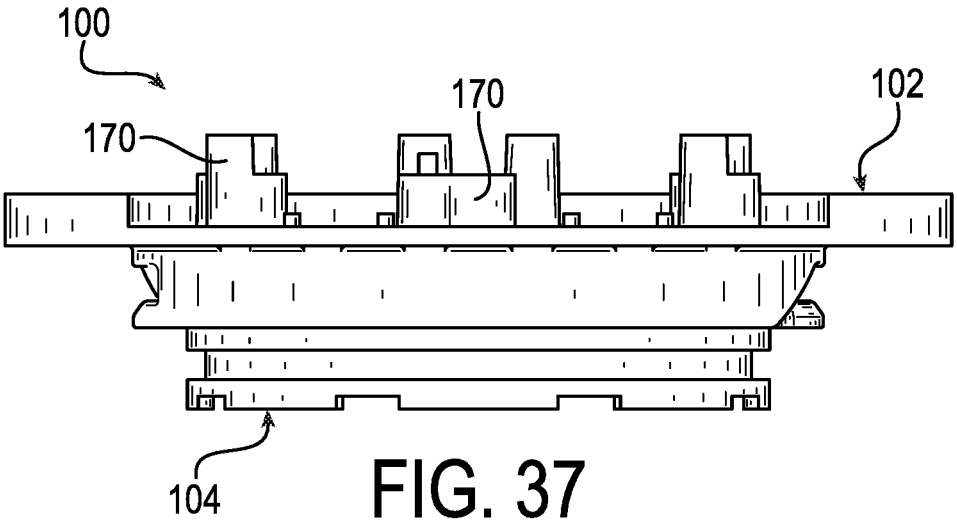
FIG. 37 is a side view of a mixing nozzle, in accordance with an example of the disclosure.
Figure 38:
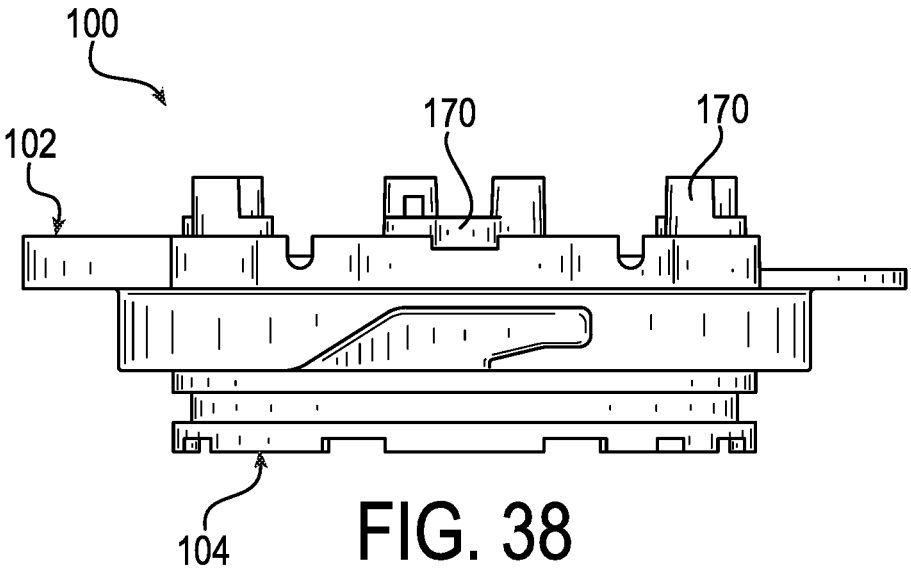
FIG. 38 is a side view of a mixing nozzle, in accordance with an example of the disclosure.
Figure 39:
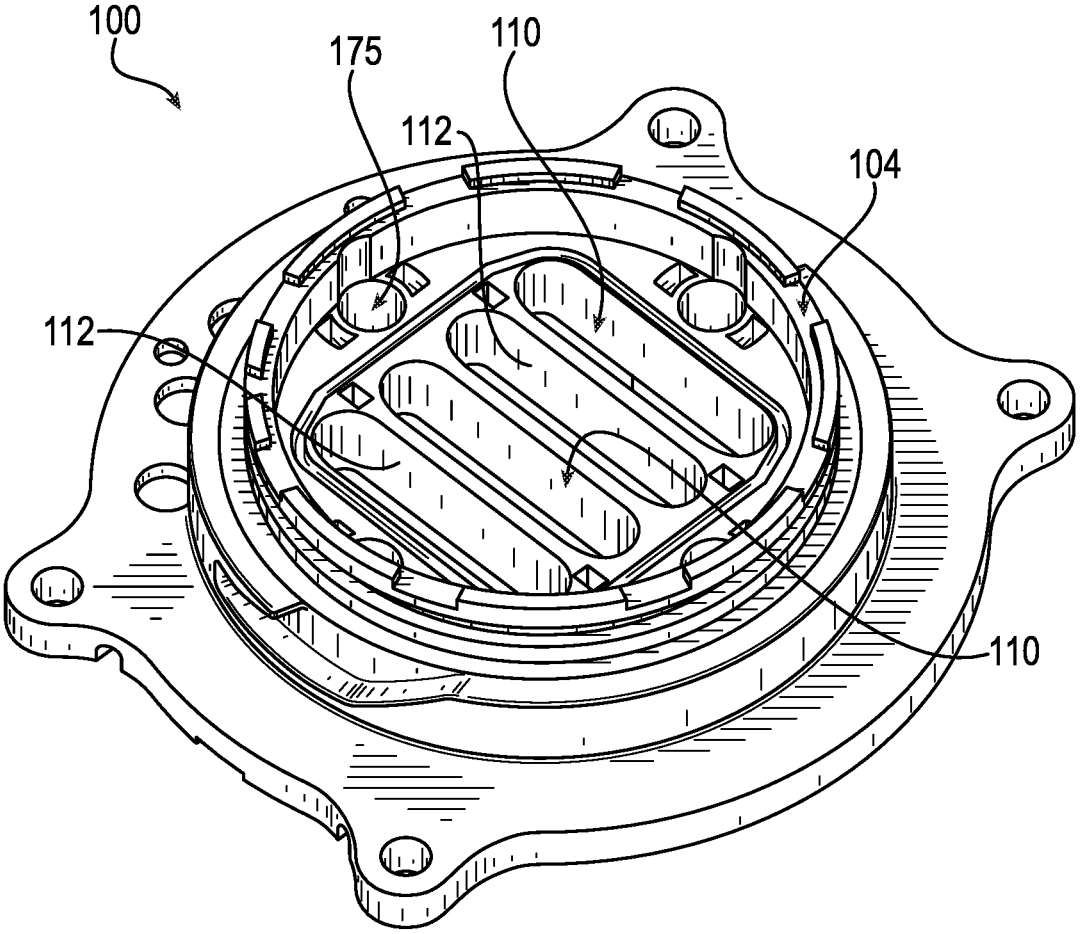
FIG. 39 is a bottom perspective view of a mixing nozzle, in accordance with an example of the disclosure.
Figure 40:
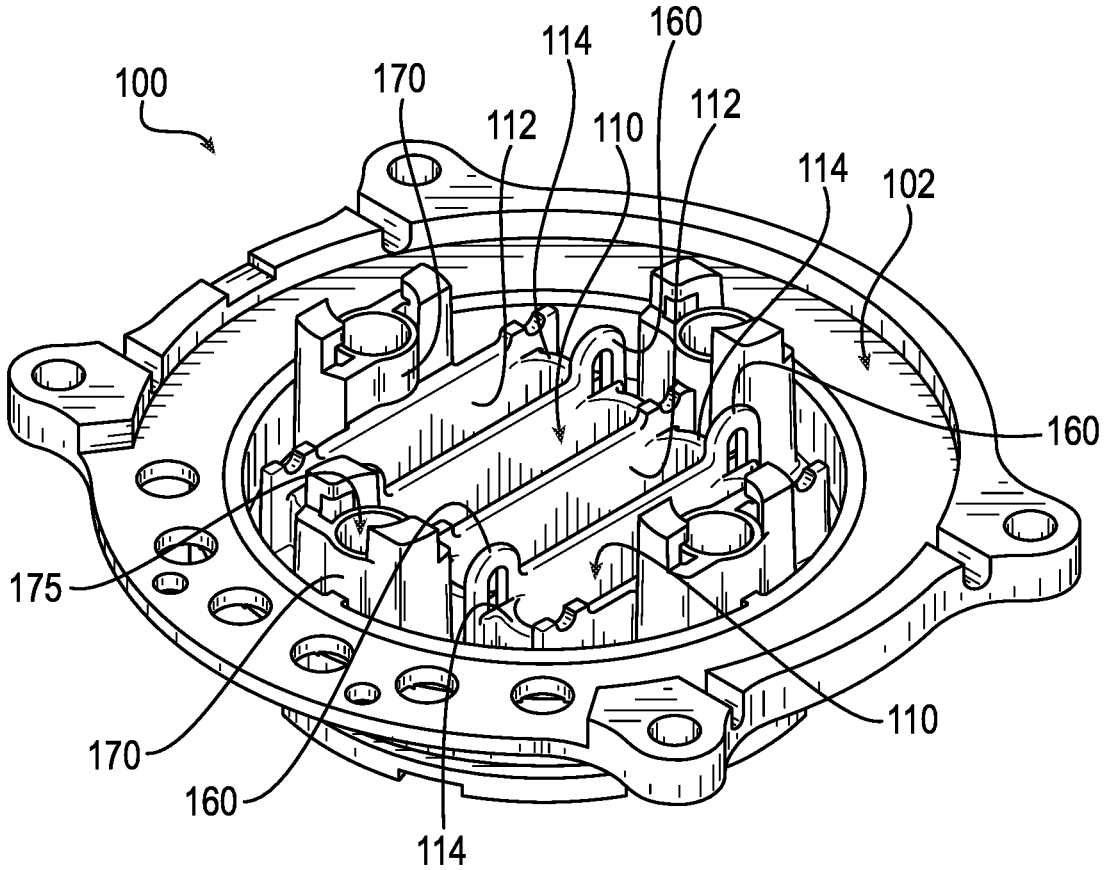
FIG. 40 is a top perspective view of a mixing nozzle having a securing mechanism, in accordance with an example of the disclosure.

As indicated above with respect to FIG. 2, additional tubes, such as water tubes 400, may be attached by other means to the mixing nozzle 100. As illustrated in FIGS. 34-35, water tube fittings 170 are additionally provided at the top side 102 of the mixing nozzle 100. The water tube fittings 170 secure water tubes 400 to the mixing nozzle 100. The water tube fittings 170 may provide for various types of a connection including a quarter-turn connection, a cam connector, a clamp, and/or the like. In yet other examples, the water tubes 400 may additionally be secured to the mixing nozzle 100 by way of the manifold 200. A water tube aperture 175 extends from the water tube fitting 170 in through the bottom side 104 of the mixing nozzle 100, as illustrated by FIG. 36, for mixing with the components distributed through the manifolds 200. Like FIGS. 34-39, FIGS. 40-45 also illustrate a mixing nozzle 100, separate from the manifolds 200 and tubes 300 and further illustrating an example of a securing mechanism, as described with respect to FIGS. 7-12.

Figure 41:
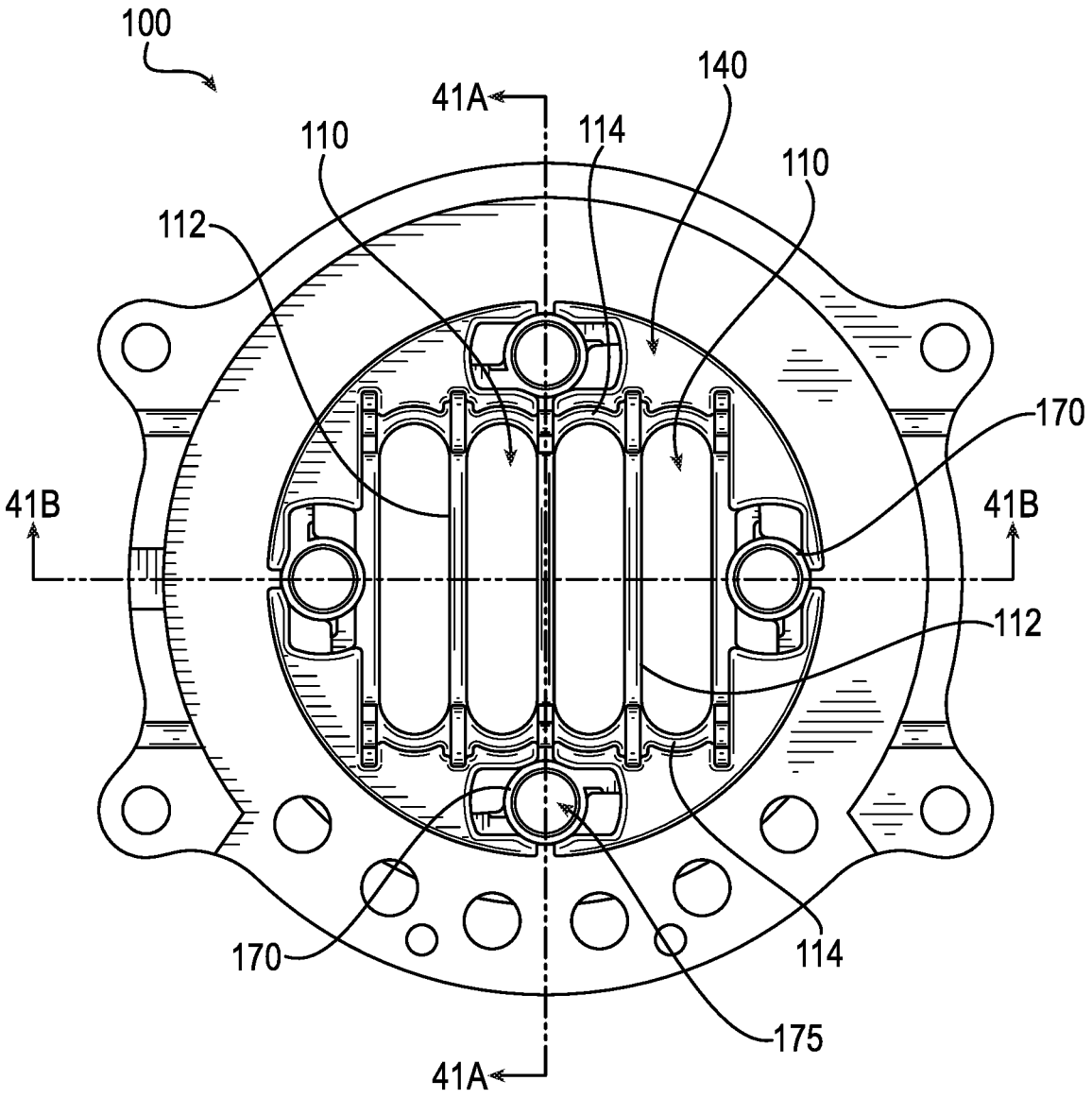
FIG. 41 is a top view of a mixing nozzle having a securing mechanism, in accordance with an example of the disclosure.
Figure 41A:
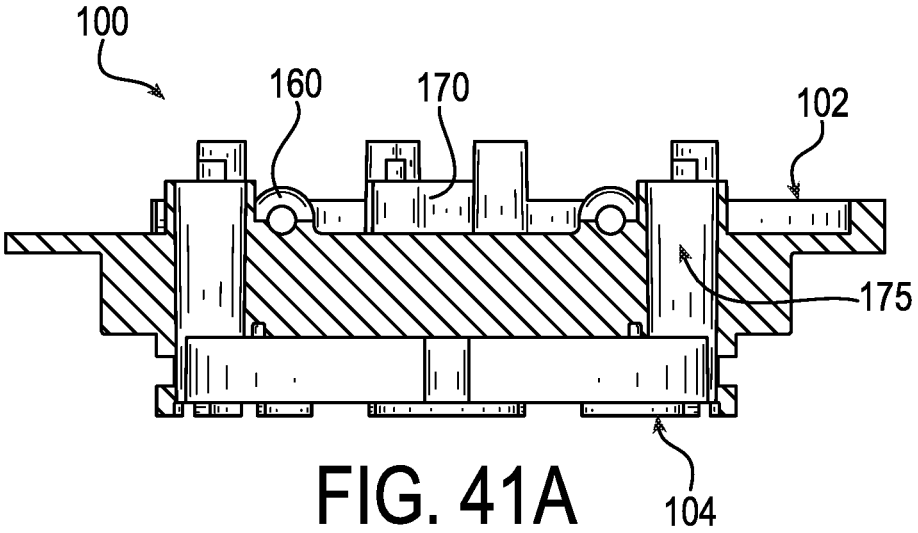
FIG. 41A is a cross-sectional view of a mixing nozzle taken along line 41A-41A of FIG. 41, in accordance with an example of the disclosure.
Figure 41B:
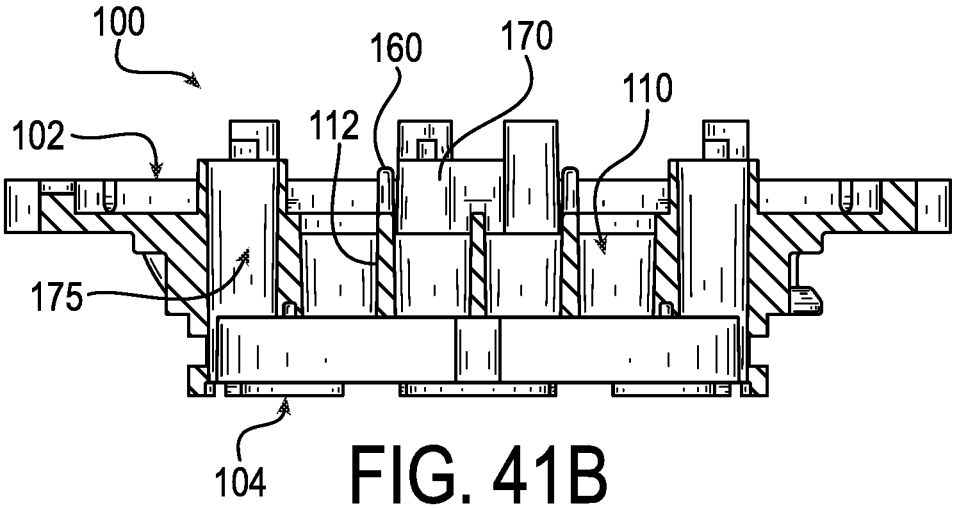
FIG. 41B is a cross-sectional view of an assembled mixing nozzle taken along line 41B-41B of FIG. 41, in accordance with an example of the disclosure.
Figure 42:
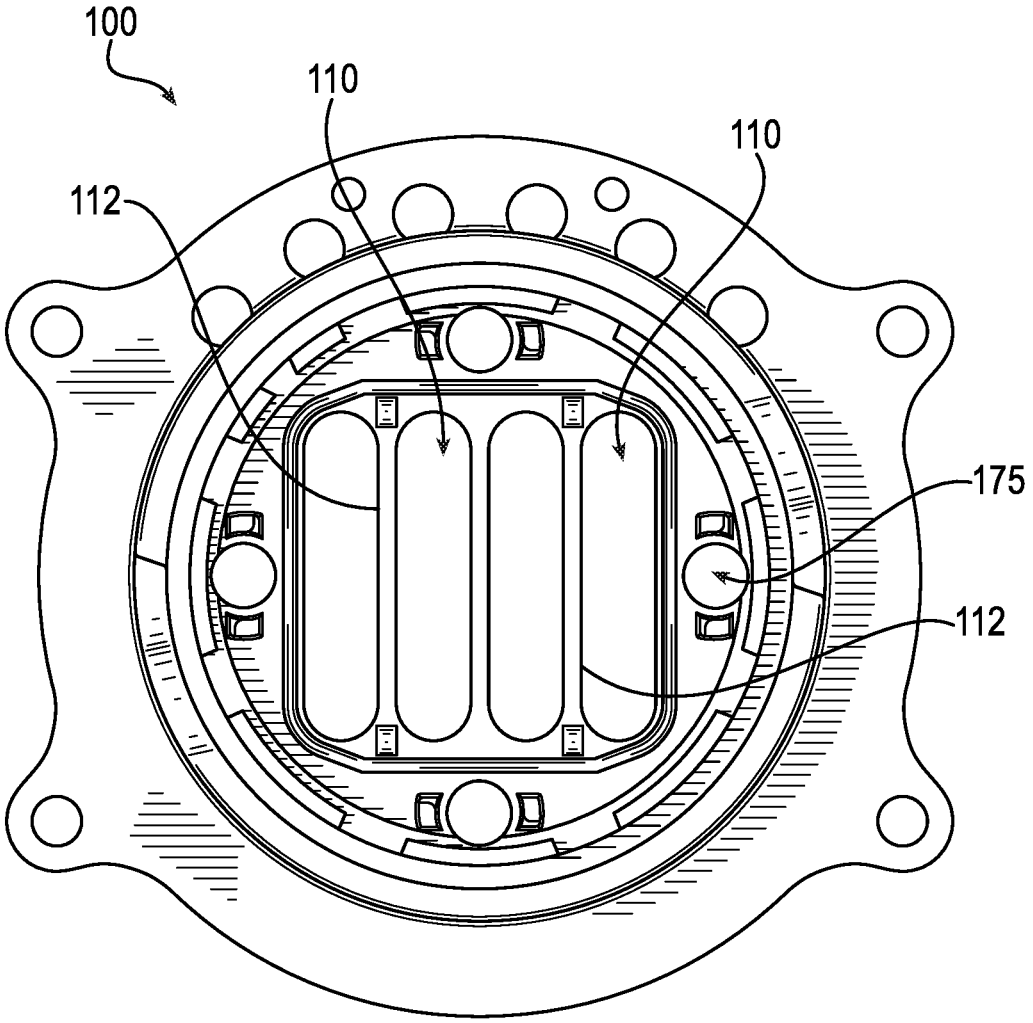
FIG. 42 is a bottom view of a mixing nozzle having a securing mechanism, in accordance with an example of the disclosure.
Figure 43:
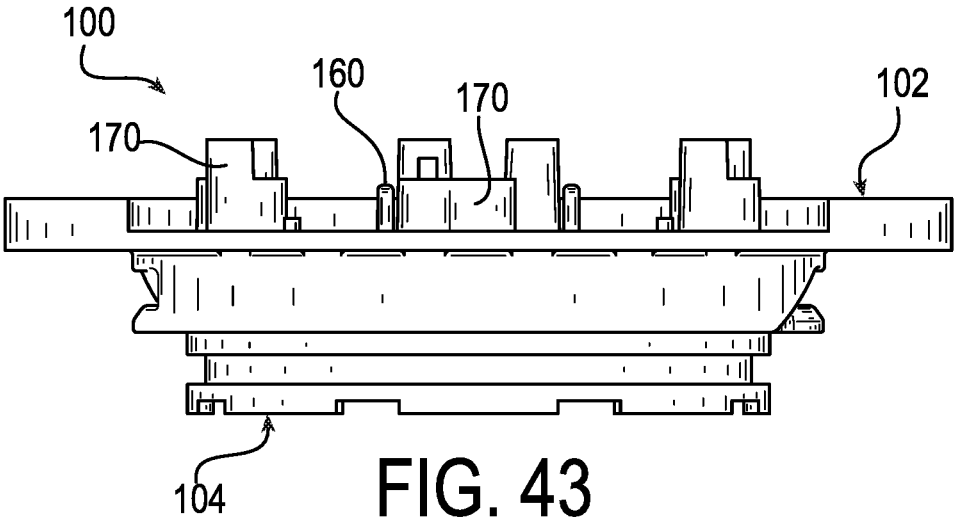
FIG. 43 is a side view of a mixing nozzle having a securing mechanism, in accordance with an example of the disclosure.
Figure 44:
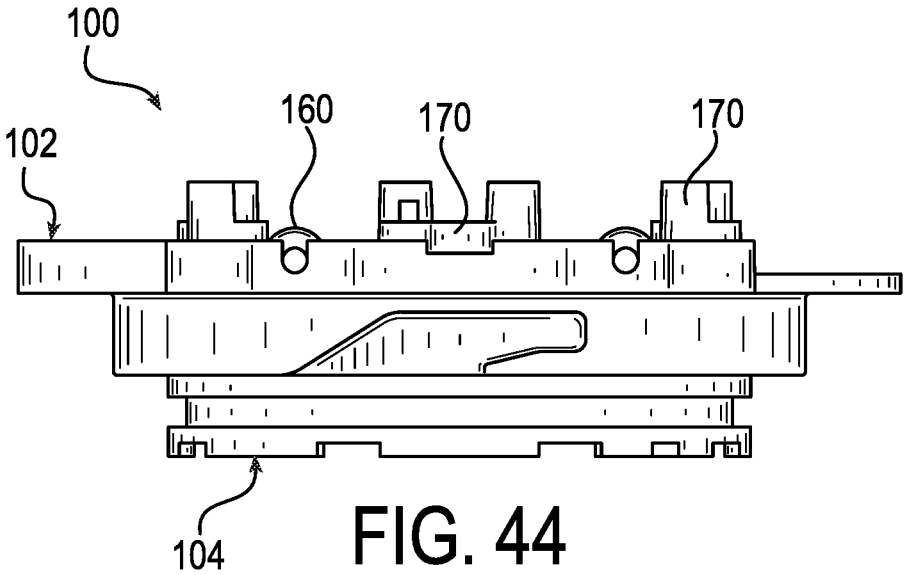
FIG. 44 is a side view of a mixing nozzle having a securing mechanism, in accordance with an example of the disclosure.
Figure 45:
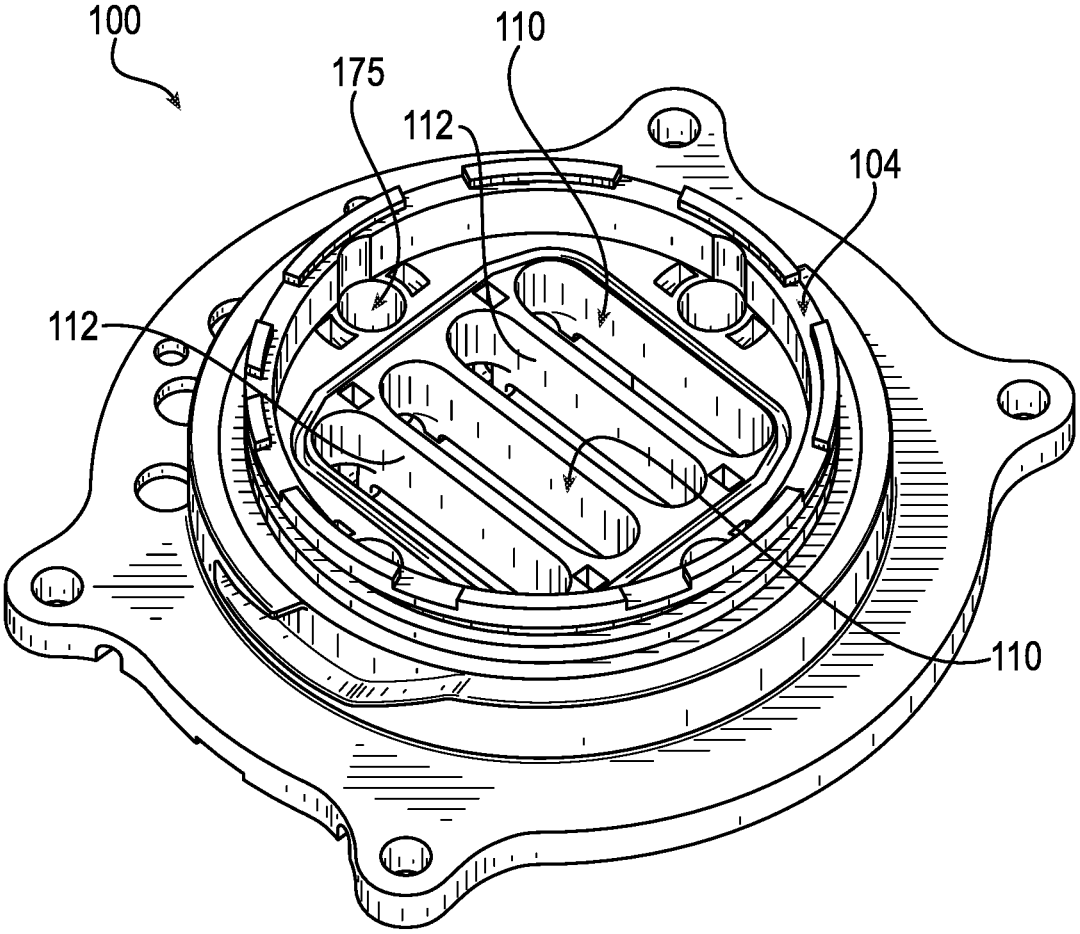
FIG. 45 is a bottom perspective view of a mixing nozzle having a securing mechanism, in accordance with an example of the disclosure.

Turning to FIGS. 41A-41B, cross-sectional views of the mixing nozzle 100 are illustrated. In FIG. 41A, taken at line 41A-41A of FIG. 41, the cross-sectional view illustrates the mixing nozzle 100 bisected between seats 110. In this example, the mixing nozzle pin openings 160 are illustrated. Also illustrated are the water tube fittings 170. In FIG. 41B, taken at line 41B-41B of FIG. 41, the cross-sectional view illustrates the mixing nozzle 100 bisecting the seats 110. In this example, the mixing nozzle pin openings 160 are additionally illustrated Like in FIG. 41A, water tube fitting 170 are additionally illustrated.

In examples of the present disclosure, a beverage dispensing system mixing nozzle comprises a plurality of manifolds inserted therein. The manifolds comprise a body having one or more pathways extending from a top side to a bottom side of the manifold. In one example, the manifold is overmolded around an end of the tubes to form a leak proof connection.

Each manifold is inserted into a seat of the mixing nozzle. The seat comprises an open top for receiving each manifold. The open top of the seat is positioned to the top side of the mixing nozzle. The seat further comprises an open bottom where the one or more pathways of the manifold open through the bottom side of the mixing nozzle. As indicated above, the seat may be formed in the mixing nozzle or may be separately formed and attached to the mixing nozzle. In one particular example, the plurality of manifolds are positioned in a side-by-side arrangement. The manifolds may additionally be collectively positioned centrally within the mixing nozzle. By having independent manifolds, a single manifold may be removed independent of any remaining manifolds. Therefore, the mixing nozzle is modifiable by providing the requisite manifold for the particular application. Additionally, the mixing nozzle is modifiable if a tube or a single manifold were to be damaged or require repair. This modifiability, alone, is a significant improvement over the prior art wherein each tube is independently clamped to a respective mixing nozzle where the entire mixing nozzle would require such modification or repair.

The tubes of each manifold may be of various sizes and configurations. By example, a single manifold may comprise multiple tubes where the interior dimension of the tubes vary, such as having varying diameters in a circular tube. In another example, a single manifold may comprise multiple tubes where the interior dimensions of the tubes are the same, such as having the same diameter in a circular tube. Additionally or alternatively, the interior dimensions (e.g. diameters) of the tubes may be the same or may vary between manifolds. This allows each manifold to be modified for the particular component being added to the beverage mixing system and further control the flow of the component by way of the interior dimension (e.g. diameter) of the tube. In addition to or alternatively, the exterior dimensions of the tubes may vary, be consistent, or a combination thereof by way of a single manifold and/or across a plurality of manifolds.

As indicated above, the beverage dispensing system mixing nozzle may further comprise at least one water tube fitting separate from a manifold for receiving a water tube.

When a manifold is positioned in each seat of the mixing nozzle and a water tube is positioned in each water tube fitting (or a blank core pin is provided in the alternative), the top side of the mixing nozzle is isolated from the bottom side of the mixing nozzle, except through the tubes and/or water tubes, when positioned within a beverage dispensing system.

The manifold may be removably secured to the mixing nozzle by way of a securing mechanism. Any manner of securing the manifold to the mixing nozzle is contemplated herein. In one specific example, one or more securing pins secure the manifold to the mixing nozzle. In this example, each manifold comprises one or more apertures, also referred to above as pin openings. In particular, each manifold may comprise an aperture positioned at each end of the manifold in a lateral direction, where the pathways are centrally positioned between the apertures. When positioned in the mixing nozzle, the aperture(s) align with corresponding aperture(s) formed in the mixing nozzle. The corresponding apertures of the mixing nozzle may be formed in the seat of the mixing nozzle. One or more apertures of the mixing nozzle may be positioned between each seating position of each manifold, thereby, providing a securing mechanism at each manifold. Alternative, the one or more apertures of the mixing nozzle may be positioned at the outermost manifolds thereby securing each manifold there between. A securing pin is then inserted through the one or more apertures of the manifold in combination with being inserted through the one or more apertures of the mixing nozzle. One or more securing pins (e.g. two securing pins)

may be provided, such as where a securing pin may be inserted to each side of the manifolds. Additionally or alternatively, a securing pin may be provided at each manifold aperture, independent of another manifold aperture. When the securing pin is in place, the manifold is maintained within the seat of the mixing nozzle. A leak-proof connection may also be provided between the manifold and the mixing nozzle by way of the securing mechanism.

The present disclosure additionally provides a method for assembling the beverage dispensing system mixing nozzle as disclosed herein. In yet another example, the method for assembly may be further modified as a method for repair of a beverage dispensing system mixing nozzle. In the method for assembling a beverage dispensing system mixing nozzle comprises the steps of:

providing a plurality of tubes;

overmolding a manifold around an end of each of the plurality of tubes to form a leak proof connection;

crosslinking the manifold and plurality of tubes as an assembly;

securing the manifold and plurality of tubes into a seat of the mixing nozzle, wherein the plurality of tubes extend outwardly from a top side of the mixing nozzle.

The method for assembling the beverage dispensing system mixing nozzle may further comprise the step of securing each of the one of the one or more manifolds to the mixing nozzle by way of a releasable securing mechanism.

In the method for repairing or modifying a beverage dispensing system mixing nozzle comprises the steps of:

removing at least one of the one or more manifolds from a seat of the mixing nozzle;

replacing the removed one or more manifolds by placing a repaired or a replacement manifold in the seat of the mixing nozzle where at least one of the one or more manifolds remains in a seat of the mixing nozzle.

Another step may be removing at least one of the one or more manifolds from the mixing nozzle without further removing the mixing nozzle from the beverage dispensing system. Yet another step may be replacing the removed one or more manifolds with a manifold having a different tube configuration than the removed one or more manifolds.

Examples of the present disclosure include apparatus and processes by which a leak-proof connection with one or more tubes, such as polymeric tubes, is achieved, such as when a leak-proof connection is formed between the manifold and tubes and when a leak-proof connection is formed between a water tube and a portion of a water tube fitting. As used in this application, the term "overmold" means the process of injection molding a second polymer over a first polymer, wherein the first and second polymers may or may not be the same. In one example of the disclosure, the composition of the overmolded polymer will be such that it will be capable of at least some melt fusion with the composition of the polymeric tube. There are several means by which this may be affected. One of the simplest procedures is to ensure that at least a component of the polymeric tube and that of the overmolded polymer is the same. Alternatively, it would be possible to ensure that at least a portion of the polymer composition of the polymeric tube and that of the overmolded polymer is sufficiently similar or compatible so as to permit the melt fusion or blending or alloying to occur at least in the interfacial region between the exterior of the polymeric tube and the interior region of the overmolded polymer. Another manner in which to state this would be to indicate that at least a portion of the polymer compositions of the polymeric tube and the overmolded polymer are miscible. In contrast, the chemical composition of the polymers may be relatively incompatible, thereby not resulting in a material-to-material bond after the injection overmolding process.

In one example of this disclosure, polymeric tubing is made from high density polyethylene which is crosslinked. Additionally, the manifolds may be crosslinked. Moreover, the entire nozzle assembly may be crosslinked. PEX contains crosslinked bonds in the polymer structure changing the thermoplastic into a thermoset. Crosslinking may be accomplished during or after the molding of the part. The required degree of crosslinking for crosslinking polyethylene tubing, according to ASTM Standard F 876, is between 65-89%. There are three classifications of PEX, referred to as PEX-A, PEX-B, and PEX-C. PEX-A is made by peroxide (Engel) method. In the PEX-A method, peroxide blending with the polymer performs crosslinking above the crystal melting temperature. The polymer is typically kept at high temperature and pressure for long periods of time during the extrusion process. PEX-B is formed by the silane method, also referred to as the "moisture cure" method. In the PEX-B method, silane blended with the polymer induces crosslinking during molding and during secondary post-extrusion processes, producing crosslinks between a crosslinking agent. The process is accelerated with heat and moisture. The crosslinked bonds are formed through silanol condensation between two grafted vinyltrimethoxysilane units. PEX-C is produced by application of an electron beam using high energy electrons to split the carbon-hydrogen bonds and facilitate crosslinking.

Crosslinking imparts shape memory properties to polymers. Shape memory materials have the ability to return from a deformed state (e.g. temporary shape) to their original crosslinked shape (e.g. permanent shape), typically induced by an external stimulus or trigger, such as a temperature change. Alternatively, or in addition to temperature, shape memory effects can be triggered by an electric field, magnetic field, light, a change in pH, or even the passage of time. Shape memory polymers include thermoplastic and thermoset (covalently crosslinked) polymeric materials.

Shape memory materials are stimuli-responsive materials. They have the capability of changing their shape upon application of an external stimulus. A change in shape caused by a change in temperature is typically called a thermally induced shape memory effect. The procedure for using shape memory typically involves conventionally processing a polymer to receive its permanent shape, such as by molding the polymer in a desired shape and crosslinking the polymer defining its permanent crosslinked shape. Afterward, the polymer is deformed and the intended temporary shape is fixed. This process is often called programming. The programming process may consist of heating the sample, deforming, and cooling the sample, or drawing the sample at a low temperature. The permanent crosslinked shape is now stored while the sample shows the temporary shape. Heating the shape memory polymer above a transition temperature $T_{trans}$ induces the shape memory effect providing internal forces urging the crosslinked polymer toward its permanent or crosslinked shape. Alternatively or in addition to the application of an external stimulus, it is possible to apply an internal stimulus (e.g., the passage of time) to achieve a similar, if not identical result.

A chemical crosslinked network may be formed by low doses of irradiation. Polyethylene chains are oriented upon the application of mechanical stress above the melting temperature of polyethylene crystallites, which can be in the range between 60° C. and 13° C. Materials that are most often used for the production of shape memory linear polymers by ionizing radiation include high density polyethylene, low density polyethylene and copolymers of polyethylene and poly(vinyl acetate). After shaping, for example, by extrusion or compression molding, the polymer is covalently crosslinked by means of ionizing radiation, for example, by highly accelerated electrons. The energy and dose of the radiation are adjusted to the geometry of the sample to reach a sufficiently high degree of crosslinking, and hence sufficient fixation of the permanent shape.

Another example of chemical crosslinking includes heating poly(vinyl chloride) under a vacuum resulting in the elimination of hydrogen chloride in a thermal dehydrocholorination reaction. The material can be subsequently crosslinked in an HCI atmosphere. The polymer network obtained shows a shape memory effect. Yet another example is crosslinked poly[ethylene-co-(vinyl acetate)] produced by treating the radical initiator dicumyl peroxide with linear poly[ethylene-co-(vinyl acetate)] in a thermally induced crosslinking process. Materials with different degrees of crosslinking are obtained depending on the initiator concentration, the crosslinking temperature and the curing time. Covalently crosslinked copolymers made form stearyl acrylate, methacrylate, and N,N'-methylenebisacrylamide as a crosslinker.

Additionally, shape memory polymers include polyurethanes, polyurethanes with ionic or mesogenic components, block copolymers consisting of polyethyleneterephthalate and polyethyleneoxide, block copolymers containing polystyrene and poly(1,4-butadiene), and an ABA triblock copolymer made from poly(2-methyl-2-oxazoline) and a poly (tetrahydrofuran). Further examples include block copolymers made of polyethylene terephthalate and polyethylene oxide, block copolymers made of polystyrene and poly(1,4-butadiene) as well as ABA triblock copolymers made from poly(tetrahydrofuran) and poly(2-methyl-2-oxazoline). Other thermoplastic polymers which exhibit shape memory characteristics include polynorbornene, and polyethylene grated with nylon-6 that has been produced for example, in a reactive blending process of polyethylene with nylon-6 by adding maleic anhydride and dicumyl peroxide.

In processing, several steps may be taken to secure an extruded polymeric tube to a manifold or fitting. The manifold or fitting may be overmolded around the ends of a set of tubes to form a leak proof connection. Alternatively, the tubes and manifold may be separately molded and crosslinked, and secured together by shape memory to form a leak proof connection. In another example, the tubes may comprise a fitting with one or more barbs that is inserted into a pathway of the manifold to form a leak proof connection. In yet another example, the fitting may further include an o-ring to form the leak proof connection.

While this disclosure has been described with reference to particular examples thereof, it shall be understood that such description is by way of illustration only and should not be construed as limiting the scope of the claimed invention. Additionally, while the disclosure has been described with reference to a beverage dispensing system mixing nozzle, it is appreciated that the present disclosure may have applications in other industries where a mixing nozzle is utilized with multiple tubes to mix various components, and leak proof connections are desired without the use of any clamp or clamps to secure the tubes to the mixing nozzle. Accordingly, the scope and content of the invention are to be defined only by the terms of the following claims. Furthermore, it is understood that the features of any specific example discussed herein may be combined with one or more features of any one or more examples otherwise discussed or contemplated herein unless otherwise stated.

What is claimed is:

1. A manifold for a beverage dispensing system mixing nozzle, the manifold comprising:

a body having a top side and a bottom side;

a plurality of pathways extending from the top side to the bottom side of the body; and a plurality of tubes, where each tube extends into a respective pathway of the body;

wherein a melt fusion overmold is defined between the body and an end of each tube such that each tube forms a leak proof connection between each respective pathway.

2. The manifold of claim 1 wherein the plurality of pathways are aligned along a length of the body.

3. The manifold of claim 1 wherein at least two tubes of the plurality of tubes comprise different dimensioned inside diameters and/or different dimensioned exterior diameters.

4. The manifold of claim 1 wherein each pathway of the plurality of pathways is the same size.

5. The manifold of claim 1 wherein the body comprises a securing mechanism for securing the manifold to a beverage dispensing system mixing nozzle.

6. The manifold of claim 5 wherein the securing mechanism is for releasably securing the manifold to the beverage dispensing system mixing nozzle.

7. The manifold of claim 1 wherein each lateral end of a length of the body comprises a securing mechanism for securing the manifold to a beverage dispensing system mixing nozzle.

8. The manifold of claim 1 wherein the plurality of tubes are free of any clamp or clamps.

9. The manifold of claim 1 wherein each tube includes a first tube end extending away from the top side of the manifold and a second tube end terminating in the manifold at the bottom side.

10. The manifold of claim 1 wherein each tube includes a first tube end extending away from the top side of the manifold and a second tube end terminating in the manifold prior to the bottom side.

11. The manifold of claim 10 further comprising a recessed section at the termination of the second end of each tube.

12. A beverage dispensing system mixing nozzle comprising:

a plurality of manifolds, each manifold comprising:

a body including a plurality of pathways extending from a top side to a bottom side, a plurality of tubes, where each tube extends into a respective pathway of the body, wherein each tube forms a leak proof connection between each respective pathway;

a seat for receiving the body of each manifold of the plurality of manifolds, the seat comprising an open top for receiving each manifold of the plurality of manifolds and an open bottom where the plurality of pathways are open through the open bottom; and at least one securing mechanism for securing each manifold of the plurality of manifolds to the seat;

wherein the at least one securing mechanism includes a securing pin extending through an opening formed in the seat and an opening formed in the manifolds.

13. The beverage dispensing system mixing nozzle of claim 12 wherein the plurality of manifolds comprise a side-by-side arrangement and arc collectively positioned centrally within the mixing nozzle.

14. The beverage dispensing system mixing nozzle of claim 12 further comprising at least one water tube fitting for receiving a water tube, where the water tube fitting is independent of the manifold.

15. The beverage dispensing system mixing nozzle of claim 12 wherein each manifold of the plurality of manifolds are secured to the seat by the same securing mechanism.

16. The beverage dispensing system mixing nozzle of claim 12 wherein each manifold of the plurality of manifolds are secured to the seat by multiple securing mechanisms.

17. The beverage dispensing system mixing nozzle of claim 12 wherein the at least one securing mechanism is a releasable securing mechanism.

18. The beverage dispensing system mixing nozzle of claim 12, wherein the plurality of manifolds comprise four manifolds.

19. The beverage dispensing system mixing nozzle of claim 12, wherein at least one of the manifolds of the plurality of manifolds comprises six pathways.

* * * * *